US012672700B2

(12) United States Patent
Ostrin et al.

(10) Patent No.: US 12,672,700 B2
(45) Date of Patent: Jul. 7, 2026

(54) ADJUSTABLE SPUR ASSEMBLIES

(71) Applicant: Equestrian Innovations, LLC, Highland Park, NJ (US)

(72) Inventors: Joshua M. Ostrin, Highland Park, NJ (US); Jason Felder, Highland Park, NJ (US)

(73) Assignee: EQUESTRIAN INNOVATIONS, LLC, Highland Park, NJ (US)

( * ) Notice: Subject to any disclaimer, the term of this patent is extended or adjusted under 35 U.S.C. 154(b) by 0 days.

(21) Appl. No.: 18/796,007

(22) Filed: Aug. 6, 2024

(65) Prior Publication Data

US 2026/0041204 A1 Feb. 12, 2026

(51) Int. Cl.
*A43C 17/02* (2006.01)

(52) U.S. Cl.
CPC ..... *A43C 17/02* (2013.01)

(58) Field of Classification Search
CPC ..... A43C 17/00; A43C 17/02; A43C 17/04; A43C 17/06
USPC ..... 54/83.2, 83.1, 49.5
See application file for complete search history.

(56) References Cited

U.S. PATENT DOCUMENTS 3,142 A * 6/1843 Reinhardt ..... A43C 17/00 54/83.1
37,880 A * 3/1863 Townsend ..... A43C 17/00 54/83.2
86,049 A * 1/1869 Woodruff ..... A43C 17/00 36/40
113,152 A * 3/1871 Fellows ..... A43C 17/00 54/83.2
242,113 A * 5/1881 Comly ..... A43C 17/00 54/83.2
635,948 A * 10/1899 Turpin ..... A43C 17/00 54/83.2
644,161 A * 2/1900 Coleman ..... B68C 3/0016 54/49.5
694,421 A * 3/1902 Ridings ..... A43C 17/00 54/83.2
769,743 A * 9/1904 Hanaway ..... A43C 17/00 54/83.2
810,049 A * 1/1906 Gilbough ..... A43C 17/00 54/83.2
931,063 A * 8/1909 Hayes ..... A43C 17/00 54/83.2
1,225,350 A * 5/1917 Negrete ..... A43C 17/00 54/83.2
3,157,013 A * 11/1964 Hayward ..... A43C 17/02 54/49.5
3,953,958 A * 5/1976 Beaston ..... A43C 17/02 54/83.2
D352,805 S * 11/1994 Martin ..... D30/157
6,536,196 B2 * 3/2003 Harrison ..... A43C 17/02 54/83.2

(Continued)

*Primary Examiner* — Timothy D Collins
*Assistant Examiner* — Maria E Graber
(74) *Attorney, Agent, or Firm* — Carter, DeLuca & Farrell, LLP

(57) ABSTRACT

An adjustable spur assembly includes a yoke configured to mount to a rider's footwear, an active tip assembly, and a control assembly. The control assembly is operably coupled to the active tip assembly and configured to enable the active tip assembly to move relative to the yoke between extended and retracted positions.

18 Claims, 25 Drawing Sheets

(56) References Cited

U.S. PATENT DOCUMENTS

| | | | | |
|---|---|---|---|---|
| 7,454,887 | B2 * | 11/2008 | Harrison | A43C 17/04<br>54/83.1 |
| 2003/0226287 | A1 * | 12/2003 | Borne | A43B 3/0031<br>36/131 |
| 2011/0225937 | A1 * | 9/2011 | Chang | A43C 17/02<br>54/83.1 |
| 2016/0120259 | A1 * | 5/2016 | Benetti | A43B 5/006<br>36/131 |

* cited by examiner

ADJUSTABLE SPUR ASSEMBLIES

TECHNICAL FIELD

The present disclosure relates to the field of equestrian equipment, specifically to spurs used in horseback riding.

BACKGROUND

A spur is a tool designed to be worn in pairs on the heels of riding boots for the purpose of directing a horse or other animal to move forward or laterally while riding. Spurs have been a vital tool in equestrian activities for centuries, traditionally used to aid in rider control over a horse. Spurs have evolved from simple devices into more sophisticated instruments that balance efficacy with the comfort of both horse and rider. Typically, spurs are attached to the rider's boots and are used to deliver cues to the horse through gentle pressure or touch.

Spurs generally include a heel band or yoke on a base end, a neck extending from the yoke, and an active tip supported on the neck at an active end for engaging a side of a horse to enable a rider to command the horse. The active tip may include, for example, a rowel or a blunt end (e.g., rounded or flat), which vary in design based on specific riding disciplines, such as dressage, show jumping, or Western riding. Different size spurs are used to accommodate a variety of factors, including the rider's leg length, the type of riding discipline, and the horse's responsiveness. Longer spurs can provide more leverage and are often used by riders with longer legs or in disciplines where precise leg placement is essential. Shorter spurs are generally preferred by riders with shorter legs or for horses that are more sensitive to cues. The variation in spur size allows for customized control, ensuring effective communication while maintaining the comfort and safety of the horse, but requires a rider to endure the effort required to remove and replace spurs, occasionally repeatedly, for achieving such customized control when, for instance, changing riding disciplines, horses, and/or when experiencing changes in horse responsiveness. Further, despite their widespread use, traditional spurs can sometimes cause discomfort or injury to the horse if not used correctly. This has led to a continuous pursuit of improved designs that enhance communication between rider and horse while minimizing potential harm.

BRIEF DESCRIPTION OF THE DRAWINGS

The accompanying drawings, which are incorporated in and constitute a part of this specification, illustrate embodiments of the disclosure and, together with a general description of the disclosure given above, and the detailed description of the embodiment(s) given below, serve to explain the principles of the disclosure, wherein.

DETAILED DESCRIPTION

Figure 1:
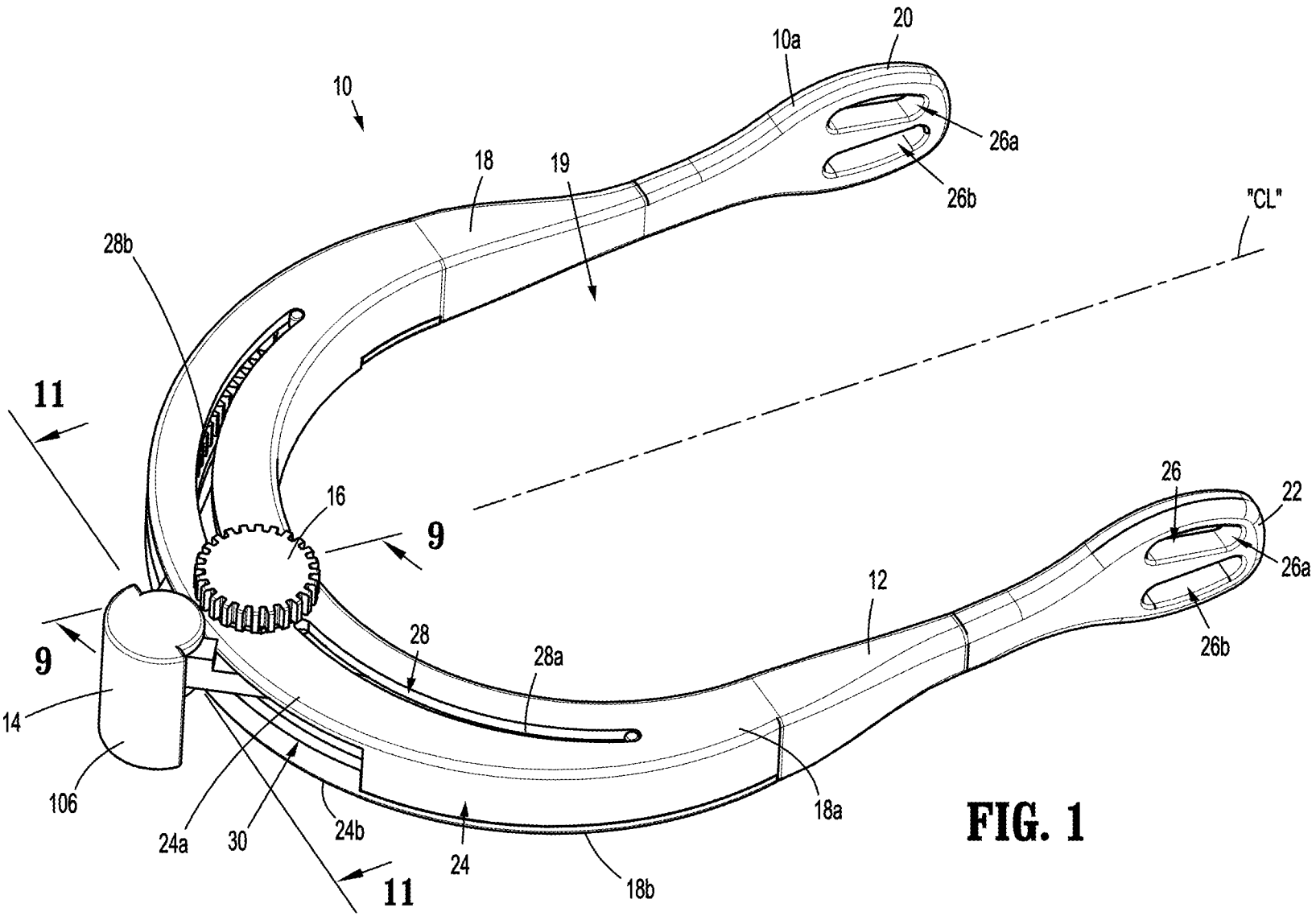
FIG. 1 is a perspective view of an adjustable spur assembly shown with an active end portion thereof in a retracted position in accordance with aspects of this disclosure.

In recent years, there has been a growing emphasis on the development of spurs that provide more refined control and increased safety. Innovations have included ergonomic designs for better fit and comfort and materials that offer both durability and flexibility. These advancements aim to address common issues such as skin irritation, uneven pressure distribution, and unintended cues.

The present disclosure seeks to further improve upon existing spur designs by incorporating novel features that enhance functionality, safety, and user experience. By addressing the limitations of prior art, this disclosure aims to provide a more effective tool for equestrian activities, promoting better communication and a more humane interaction between rider and horse.

Embodiments of the presently disclosed spur assemblies are described in detail with reference to the drawings, in which like reference numerals designate identical or corresponding elements in each of the several views.

As used herein the term "distal" refers to that portion of the assembly, device, and/or component thereof, farther from the user, while the term "proximal" refers to that portion of the assembly, device, and/or component thereof, closer to the user.

Figure 2:
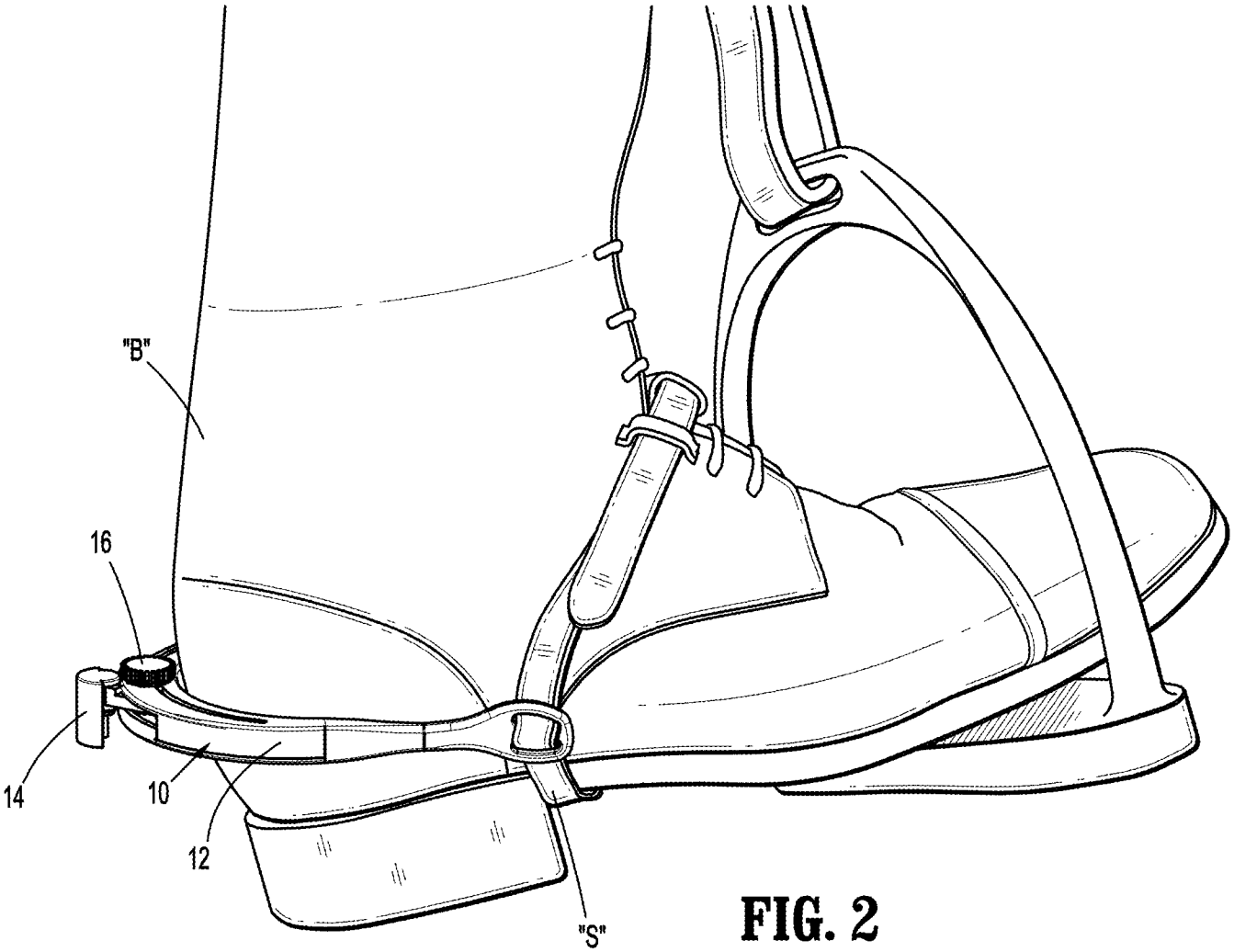
FIG. 2 is a perspective view of the adjustable spur assembly of FIG. 1 shown secured to a rider's boot and illustrating the rider's boot received in a stirrup.
Figure 14:
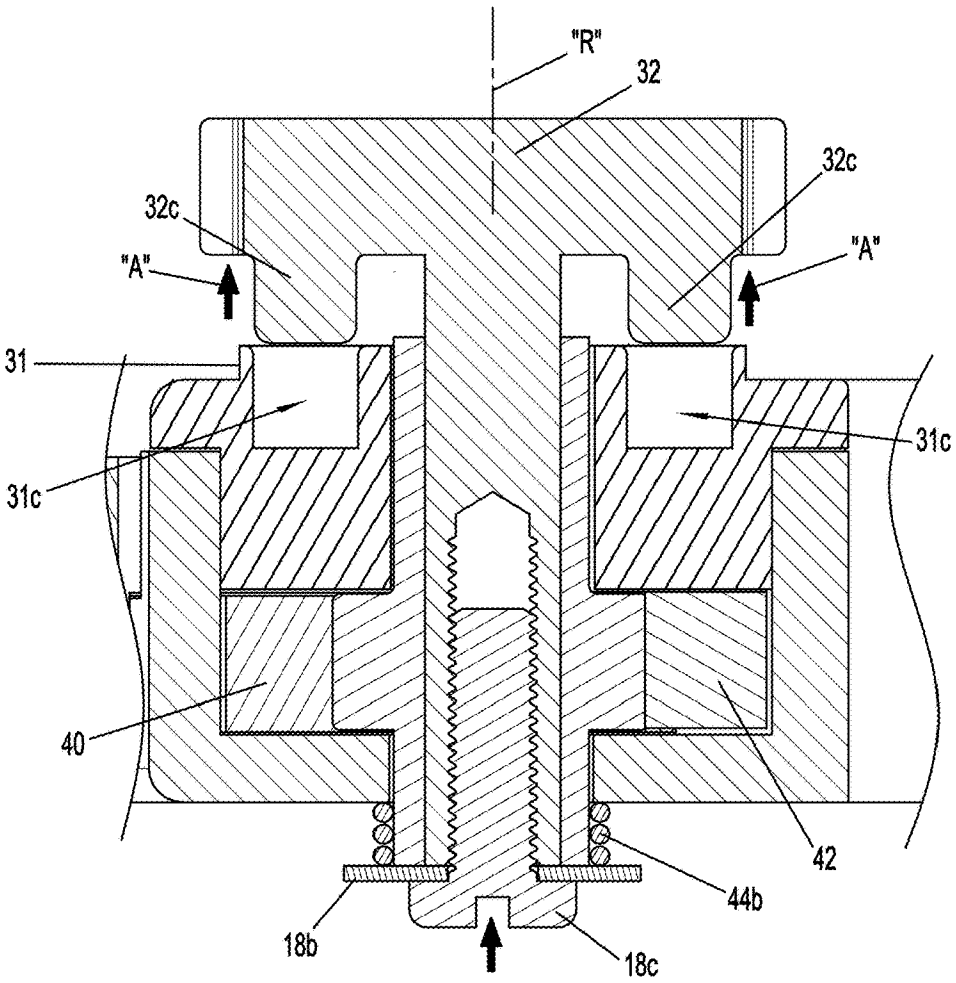
FIGS. 13-16 are progressive views illustrating the active end portion of the adjustable spur assembly of FIG. 1 being moved from the retracted position to an extended position.
Figure 13:
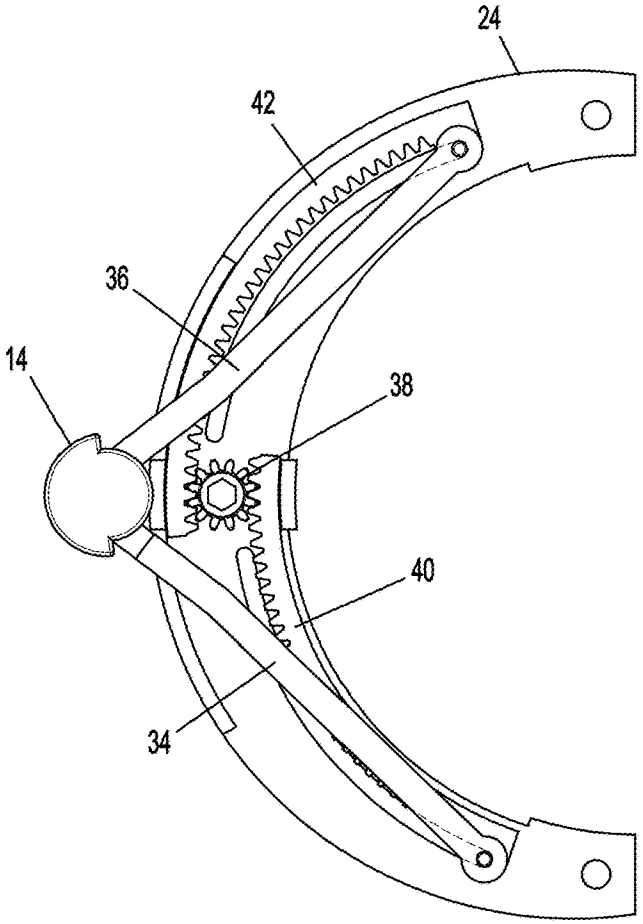
Figure 15:
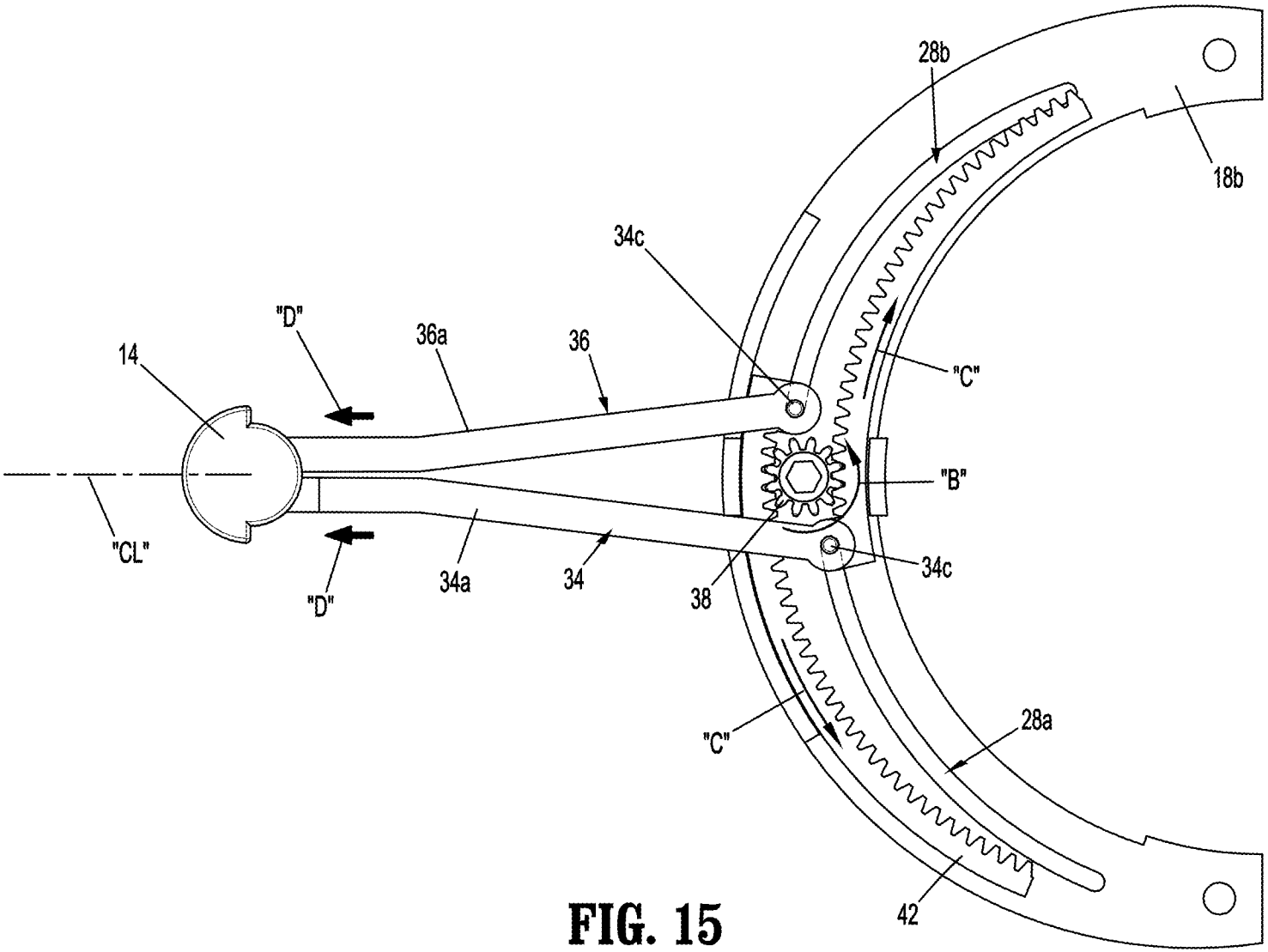
Figure 16:
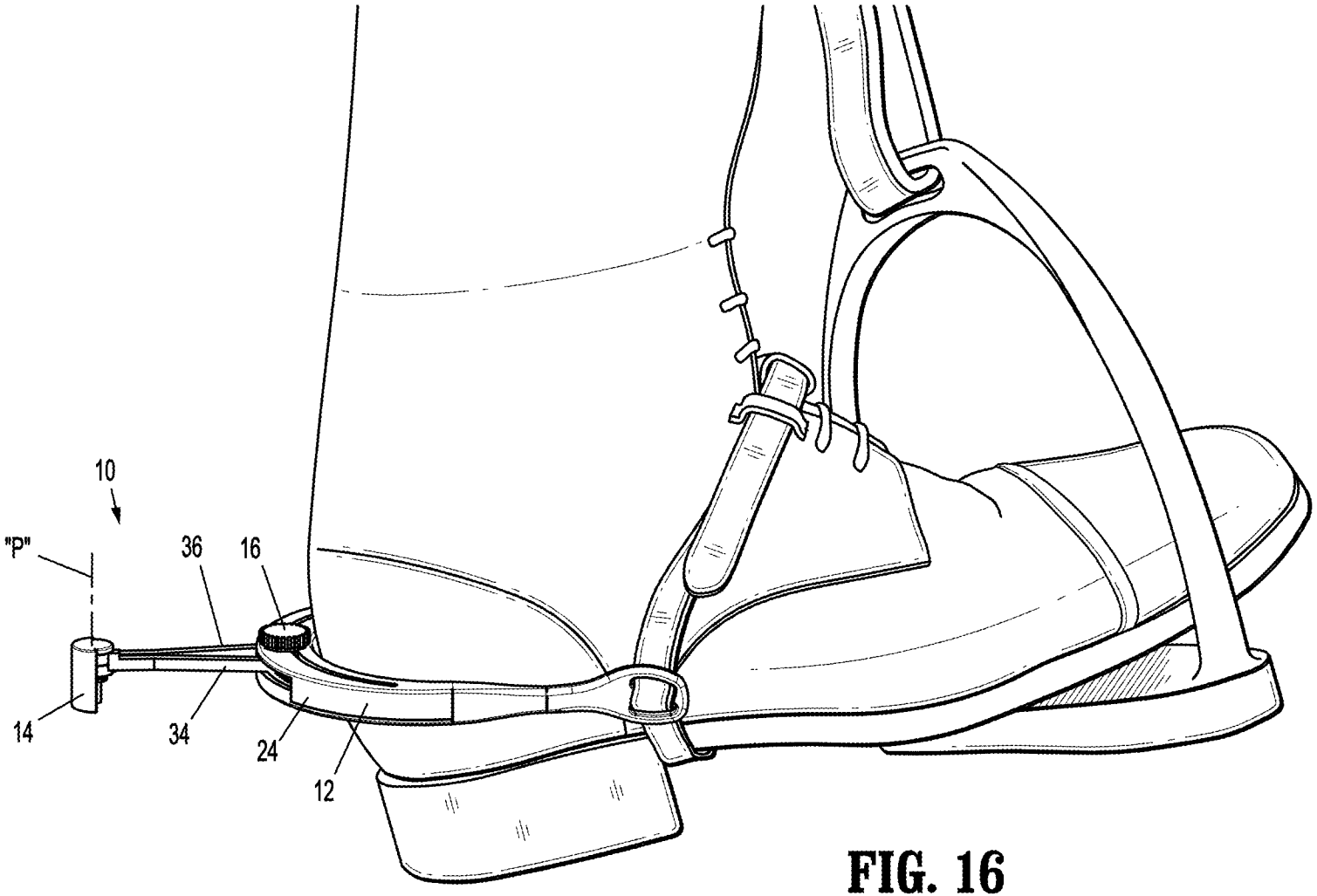
Figure 17:
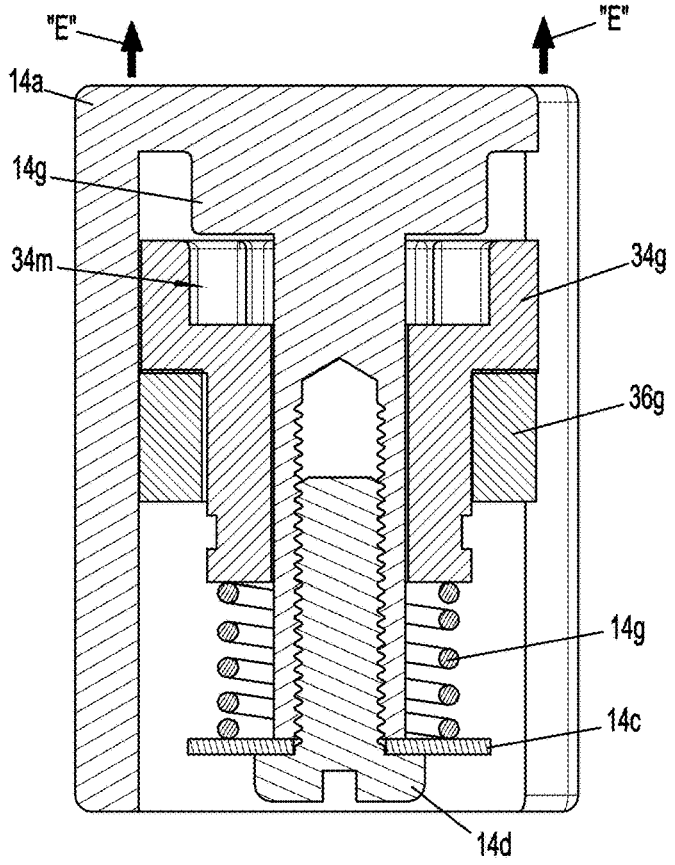
FIG. 17 is a view of FIG. 11 illustrating the active tip being moved from the locked position shown in FIG. 11 to an unlocked position.
Figure 18:
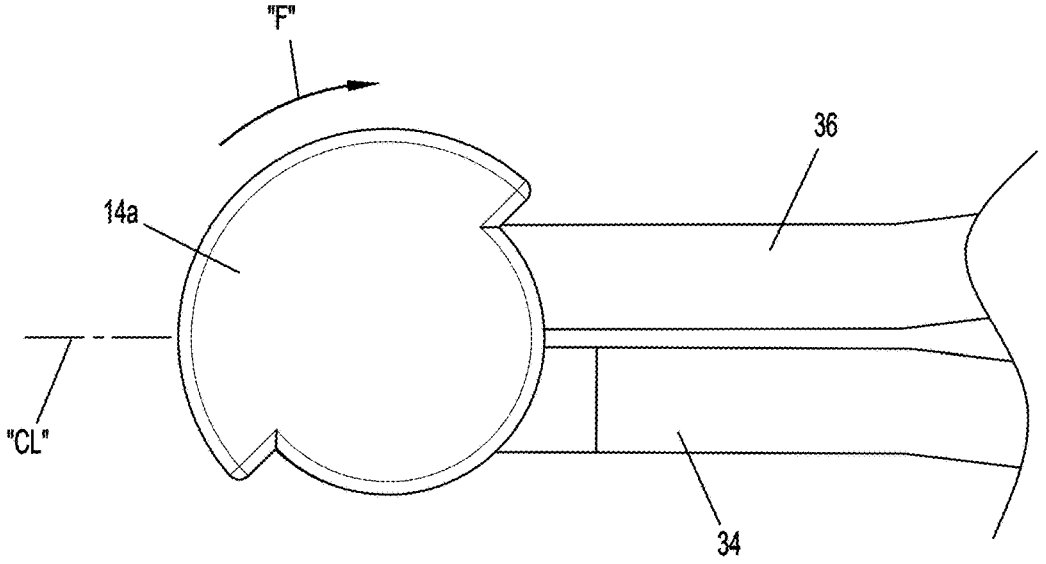
FIG. 18 is a top view of a distal end portion of the active end portion of the adjustable spur assembly of FIG. 1, the view illustrating the active tip being rotated relative to legs of the active end portion from the first rotational position to a second rotational position.
Figure 19:
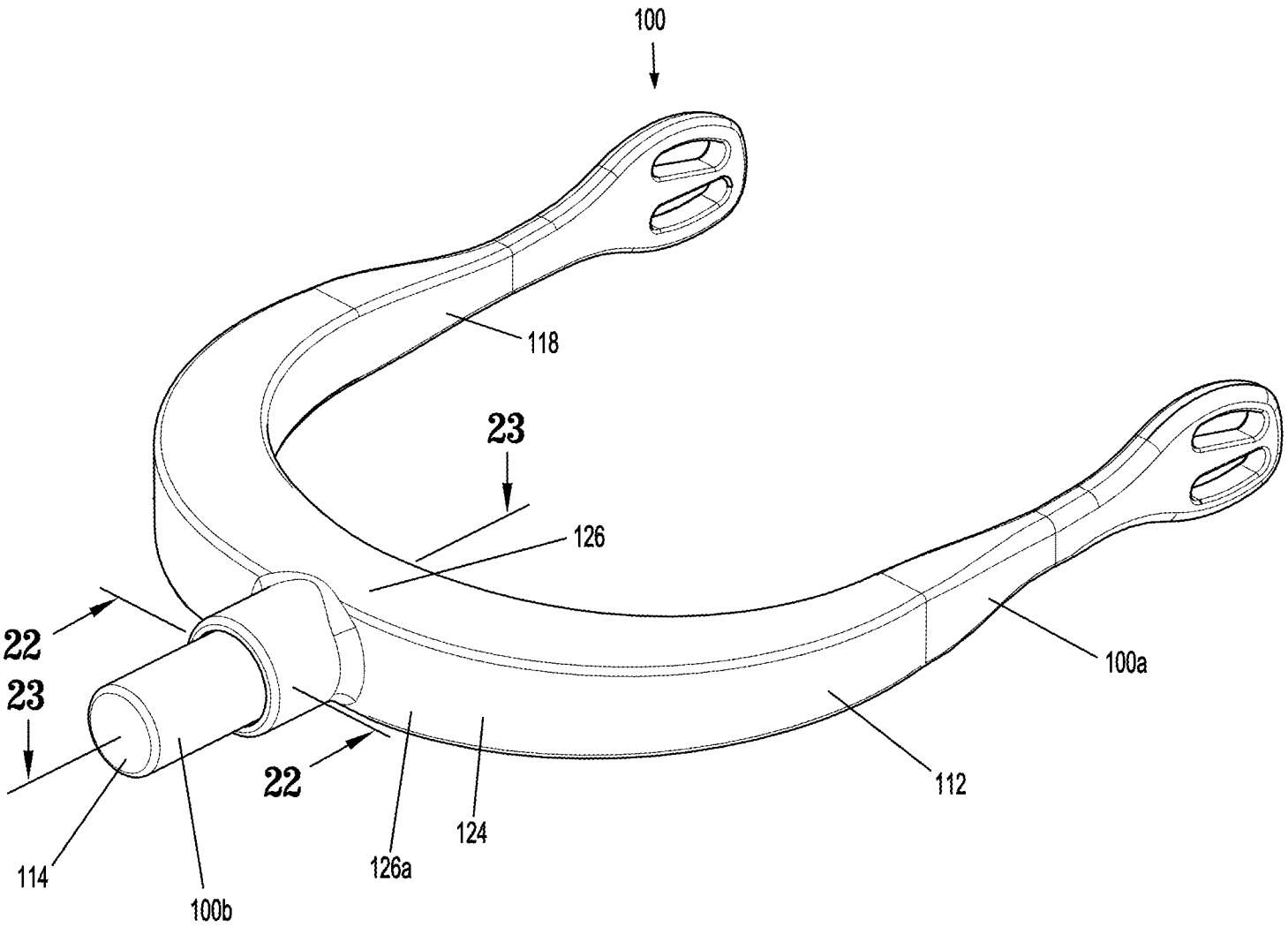
FIG. 19 is a perspective view of another adjustable spur assembly shown with an active end portion thereof in an extended position in accordance with aspects of this disclosure.
Figure 20:
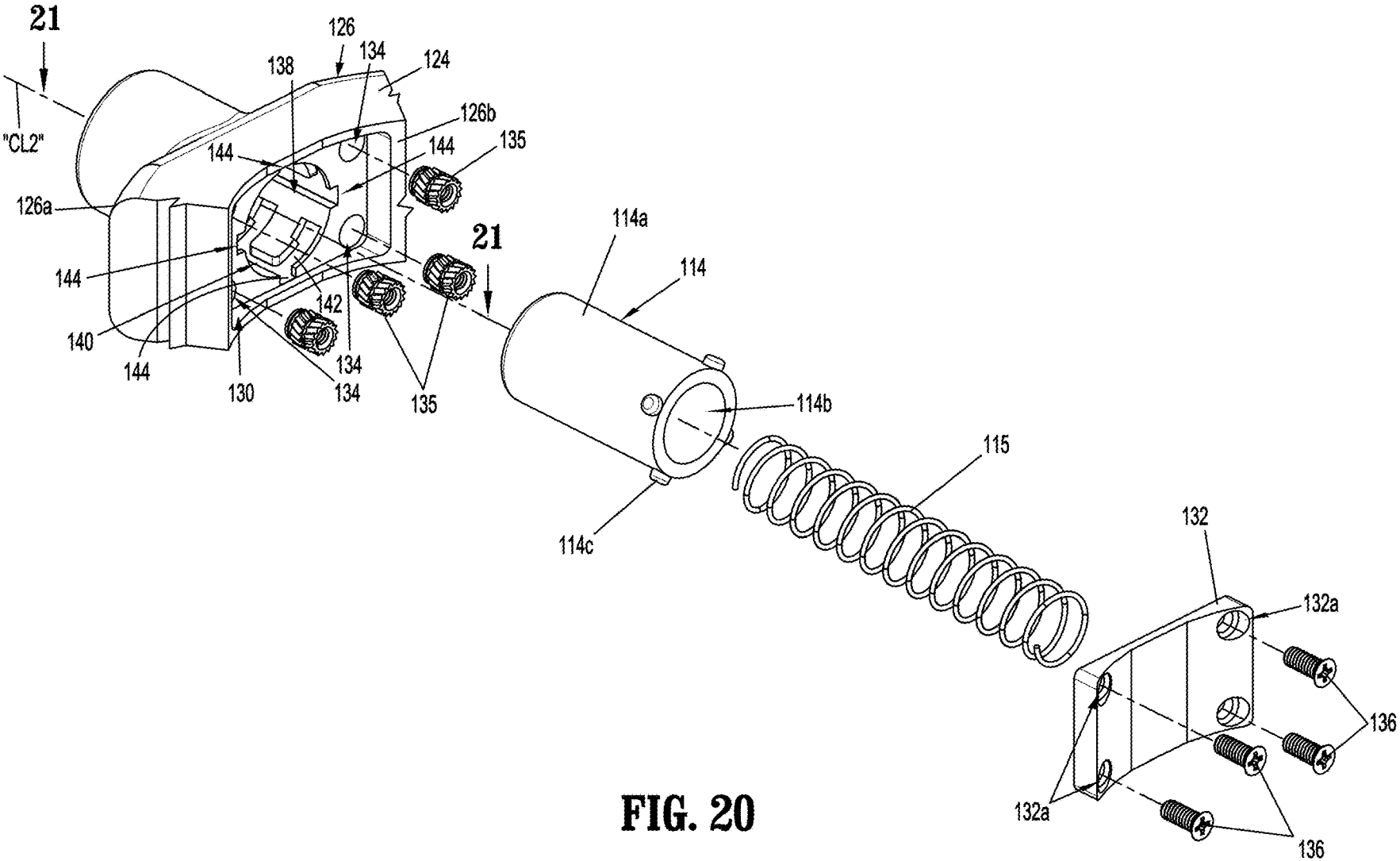
FIG. 20 is a perspective view, with parts separated, of a portion of the adjustable spur assembly of FIG. 19.
Figure 21:
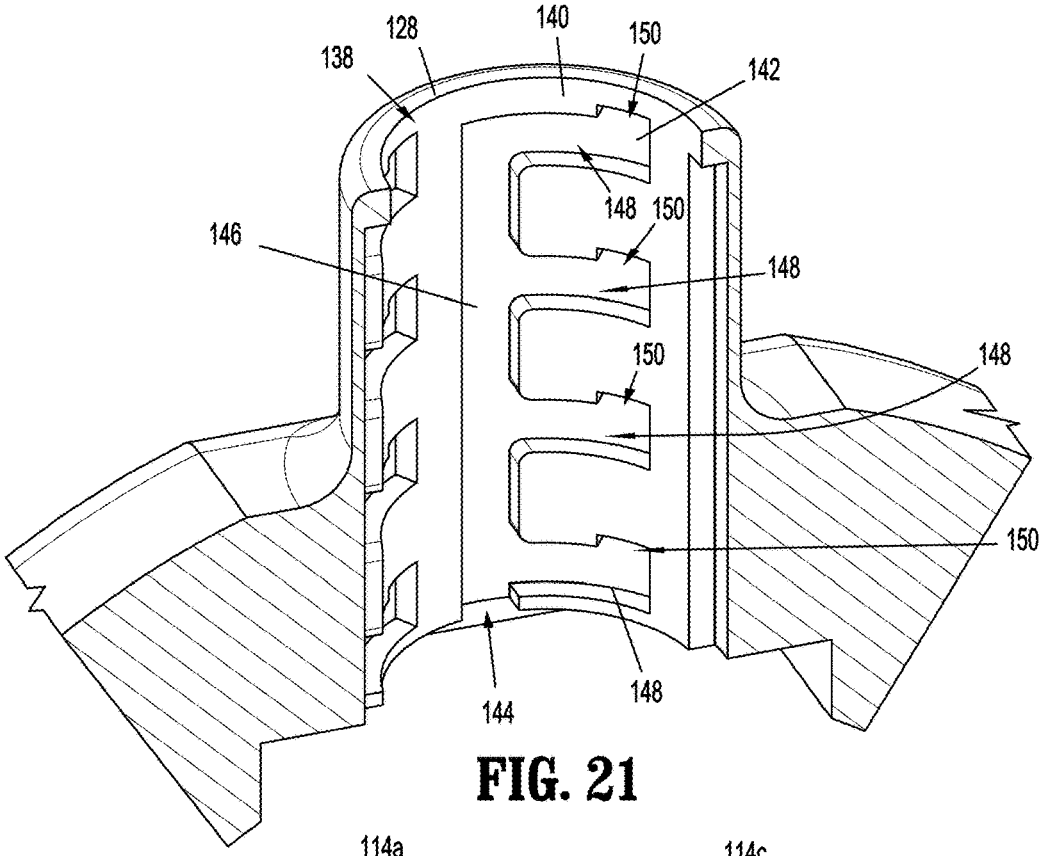
FIG. 21 is a cross-sectional view of a portion of the adjustable spur assembly of FIG. 19 as taken along section line 21-21 shown in FIG. 20.
Figure 22:
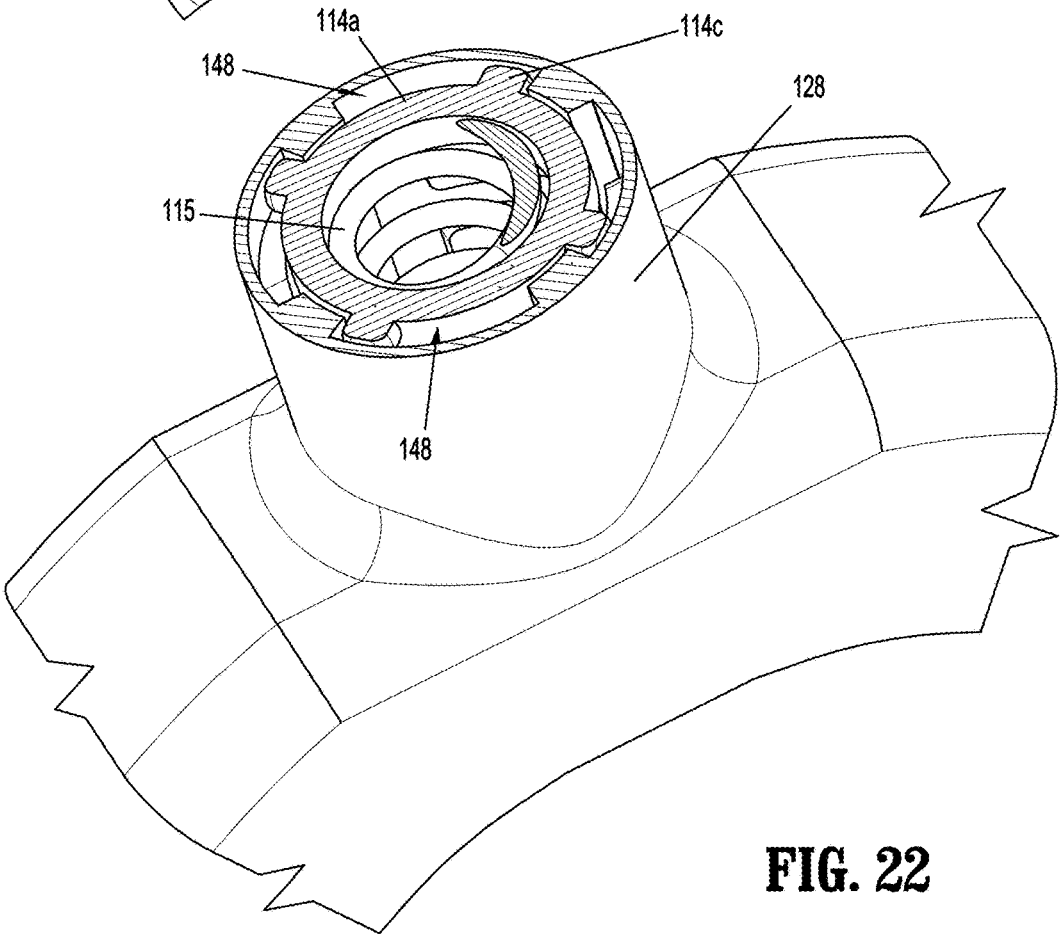
FIG. 22 is a cross-sectional view of a portion of the adjustable spur assembly of FIG. 19 as taken along section line 22-22 shown in FIG. 19.
Figure 24:
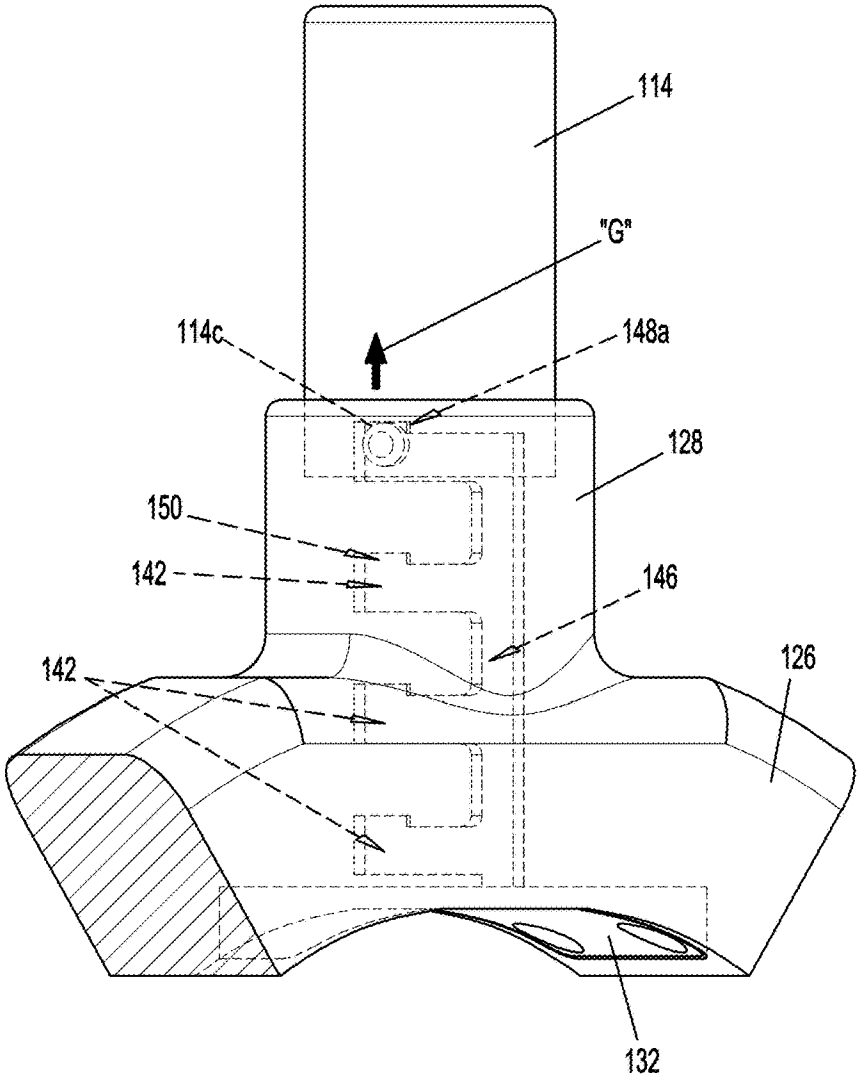
FIGS. 24-30 are progressive views of portions of the adjustable spur assembly of FIG. 19 illustrating the active end portion thereof moving between extended and retracted positions thereof.
Figure 23:
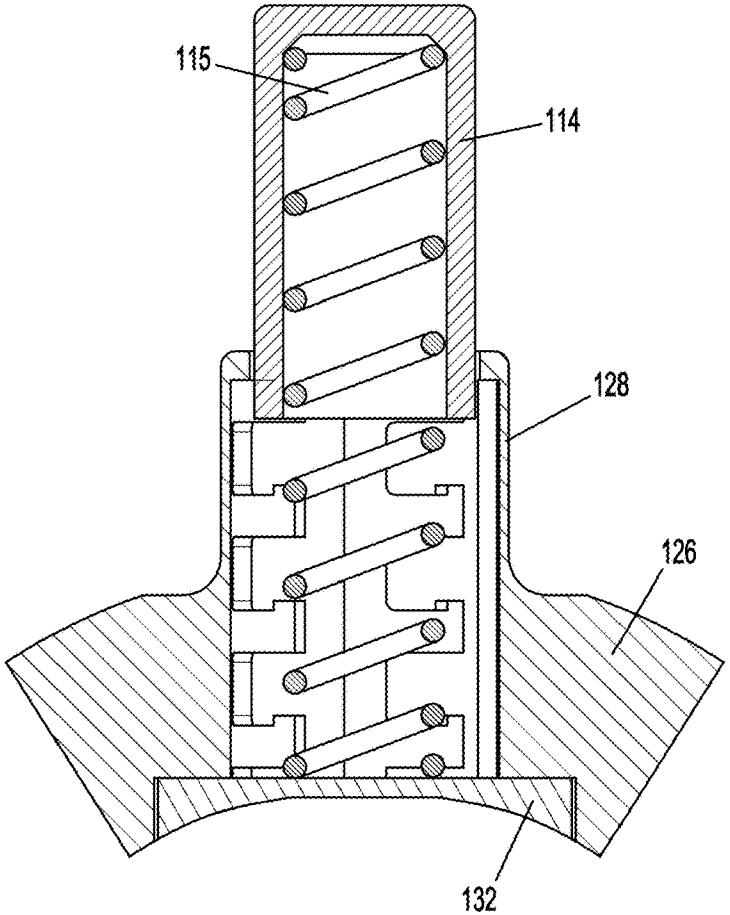
FIG. 23 is a cross-sectional view of a portion of the adjustable spur assembly of FIG. 19 as taken along section line 23-23 shown in FIG. 19.
Figure 26:
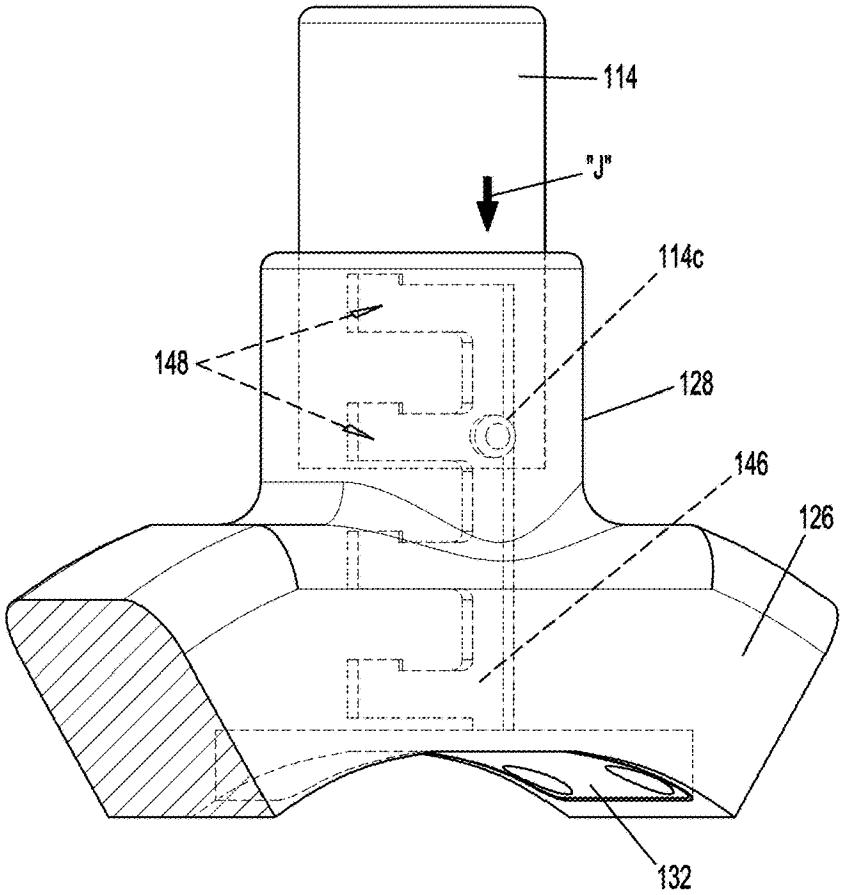
Figure 25:
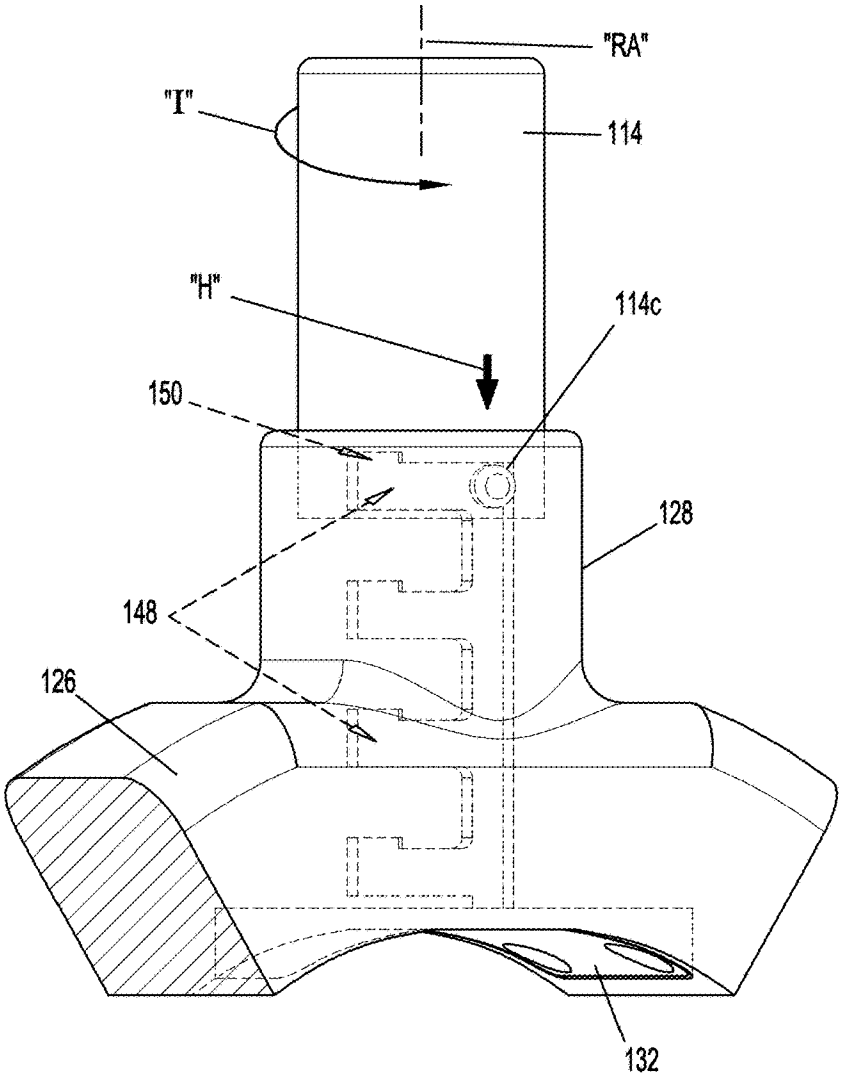

Turning now to FIGS. 1-18, an adjustable spur assembly, in accordance with the present disclosure, is generally referred to as 10 and is securable to a rider's boot "B" via a strap "S" for enabling the rider to direct a horse (or other animal) to move, for example, forward or laterally while the rider rides the horse. The adjustable spur assembly 10 has a proximal or base end portion 10*a* and a distal or active end portion 10*b* that extends distally from the base end portion 10*a*. The adjustable spur assembly 10 includes a yoke 12, an active tip assembly 14, and a control assembly 16 that couples the yoke 12 and the active tip assembly 14 together and functions to enable the active tip assembly 14 to move relative to the yoke 12 between one or more retracted (FIGS. 1 and 2) and/or extended positions (FIGS. 15 and 16).

The yoke 12 of the adjustable spur assembly 10 has a U-shaped body 18 defining a heel opening 19 for receiving a rider's boot heel. The U-shaped body 18 of the yoke 12 has an upper housing portion 18*a* and a lower housing portion 18*b* that are secured together by fasteners 18*c*. U-shaped body 18 includes a first arm 20 and a second arm 22 that are connected together by a curved heel 24. Each of the first and second arms 20, 22 defines elongated slots 26, including an upper elongated slot 26*a* and a lower elongated slot 26*b*, in a distal end portion of respective first and second arms 20, 22 for receiving the strap "S" therethrough to enable securement of the adjustable spur assembly 10 to the rider's footwear (e.g., a boot "B"). The curved heel 24 defines cam channels 28 including a first cam channel 28*a* and a second cam channel 28*b* that are disposed on opposite sides of a centerline "CL" of the adjustable spur assembly 10 and extend around the curved heel 24 and through the upper housing portion 18*a* and the lower housing portion 18*b*. The cam channels 28 have arcuate configurations that correspond to curvature of the curved heel 24, but curve in opposite directions relative to one another and each away from the centerline "CL." The first cam channel 28*a* is radially offset from the second cam channel 28*b* and has a different radius of curvature than the second cam channel 28*b*. The curved heel 24 further defines a distal opening 30 that extends through a distal end of the curved heel 24 between a ledge 24*a* of the upper housing portion 18*a* of the curved heel 24 and a lip 24*b* of the lower housing portion 18*b* of the curved heel 24. The distal opening 30 has an arcuate configuration that corresponds to the curvature of the curved heel 24. The curved heel 24 further supports a control knob lock assembly 31 mounted along the center line "CL" of the adjustable spur assembly 10 on the upper housing portion 18*a* of the curved heel 24 between the first cam channel 28*a* and a second cam channel 28*b*.

Figure 5:
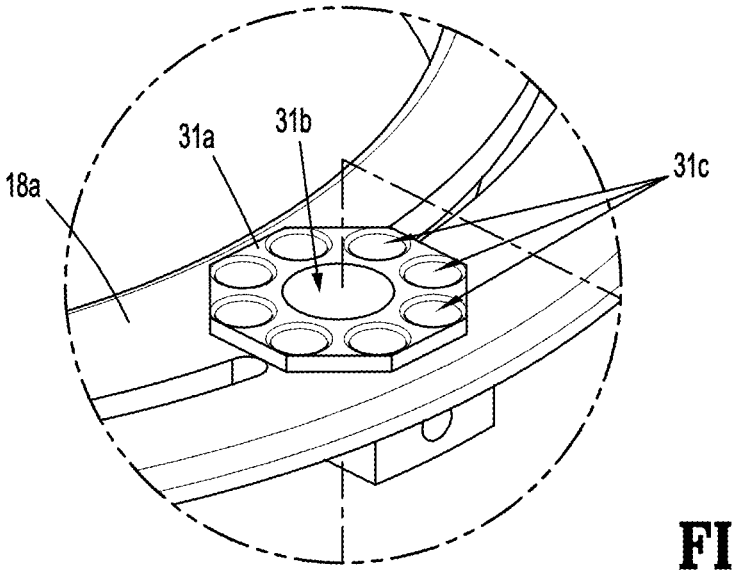
FIG. 5 is an enlarged, perspective view of the indicated area of detail shown in FIG. 4.

As seen in FIG. 5, the control knob lock assembly 31 of the curved heel 24 includes a plate 31*a* that defines a central opening 31*b* through the plate 31*a* and a plurality of lock holes 31*c* around the central opening 31*b*. The lock holes 31*c* are radially spaced from the central opening 31*b* and are disposed circumferentially about the periphery of the plate 31*a* in a spaced-apart relationship relative to one another (e.g., angularly spaced apart).

Figure 3:
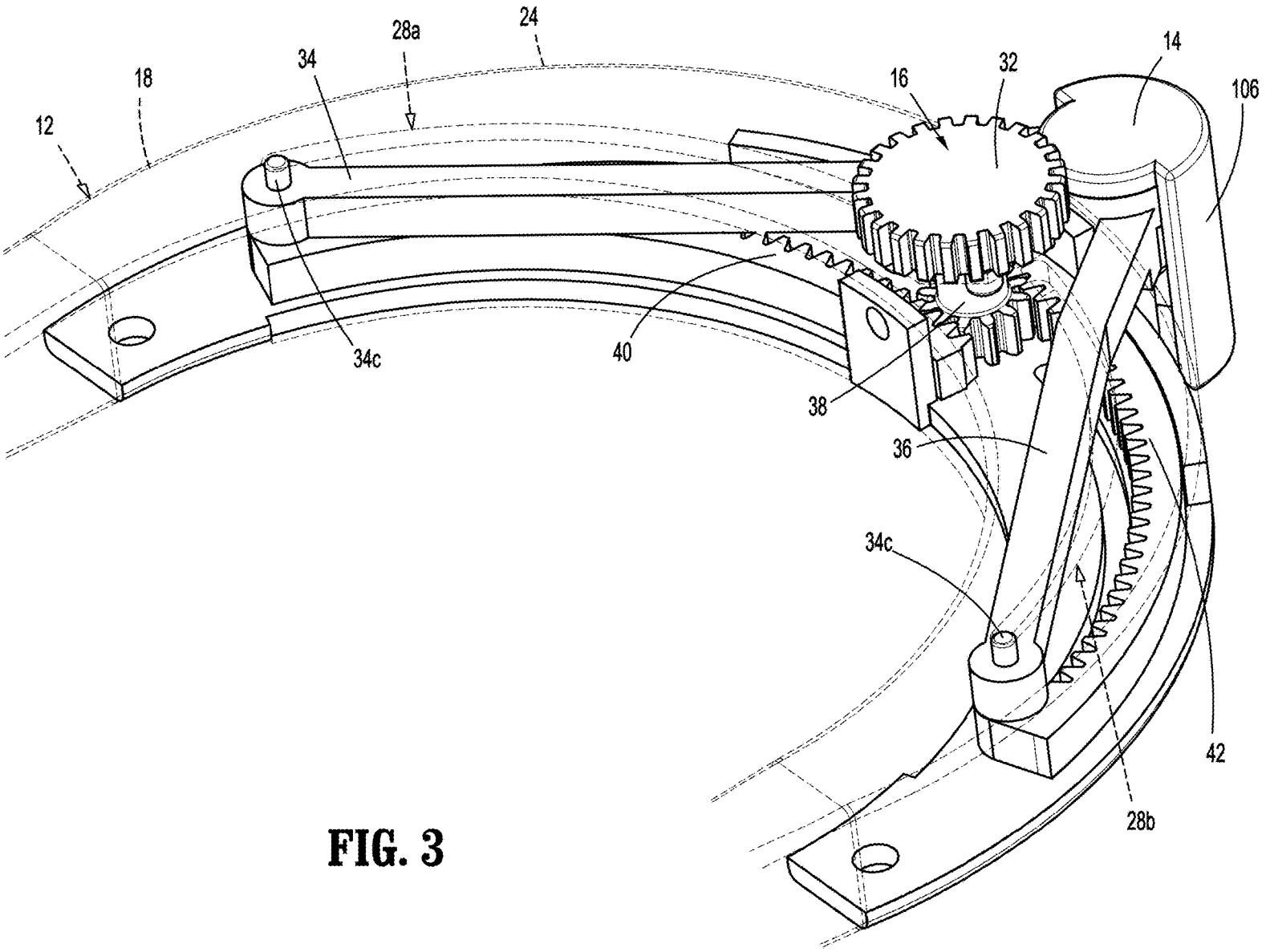
FIG. 3 is an enlarged, perspective view of a distal end portion of the adjustable spur assembly of FIG. 1 with portions thereof shown in phantom for clarity.
Figure 4:
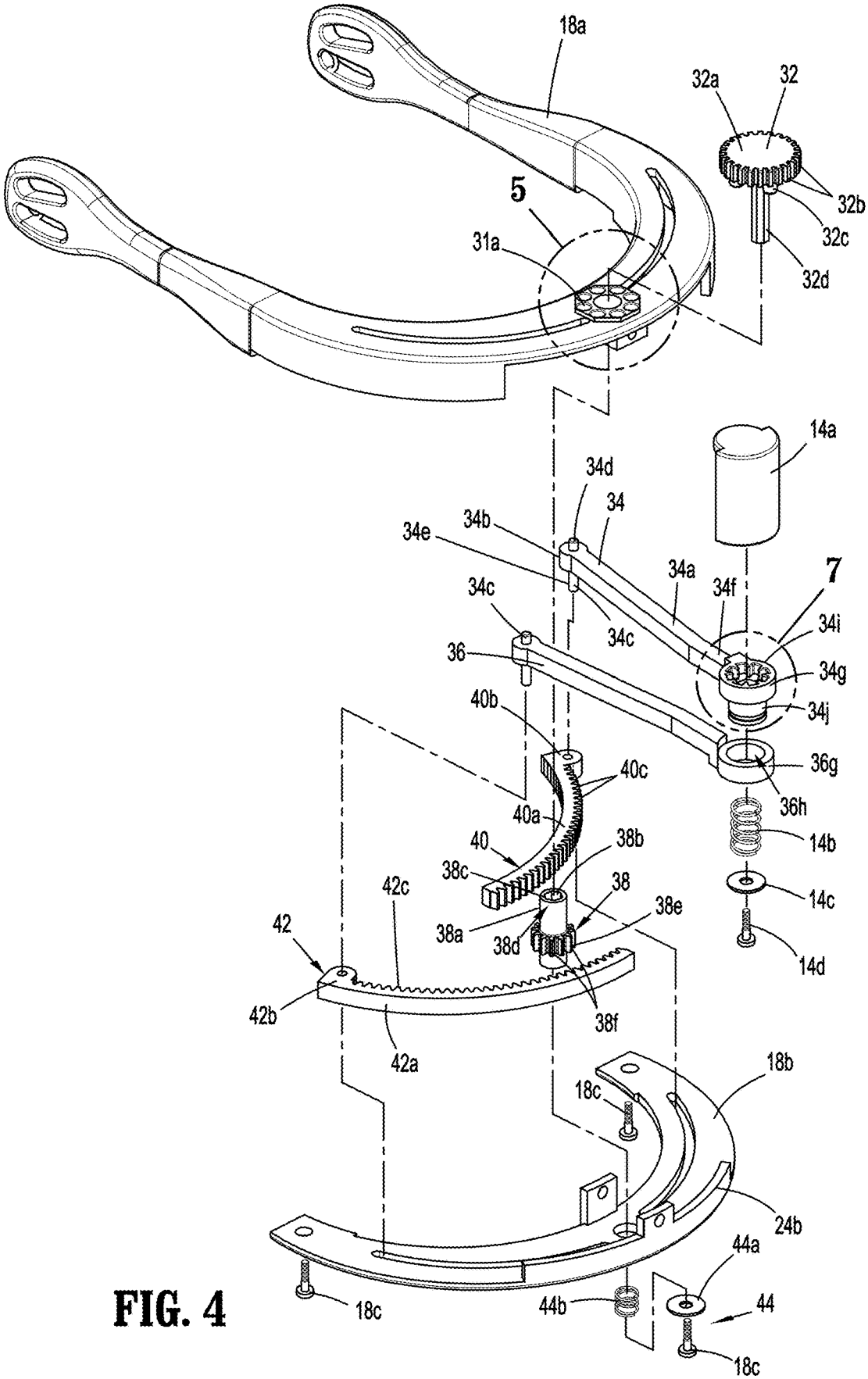
FIG. 4 is a perspective view, with parts separated, of the adjustable spur assembly of FIG. 1.

With reference to FIGS. 3 and 4, the control assembly 16 of the adjustable spur assembly 10 includes a control knob 32, a first leg assembly 34, a second leg assembly 36, a pinion gear assembly 38, a first curved rack 40, a second curved rack 42, and a spring assembly 44.

Figure 6:
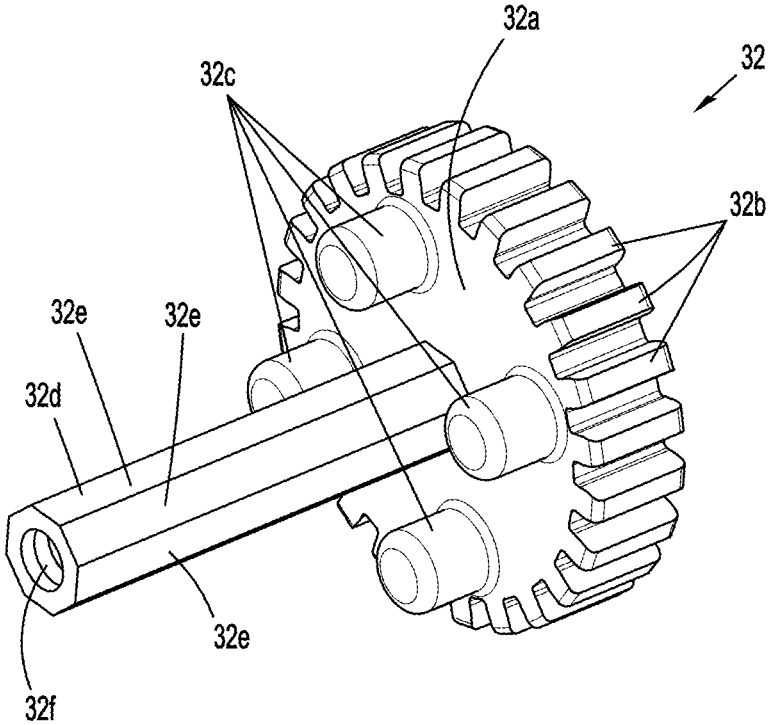
FIG. 6 is an enlarged, perspective view of a control knob of the adjustable spur assembly of FIG. 1.

As seen in FIG. 6, the control knob 32 of the control assembly 16 includes a gear plate 32*a* defining teeth 32*b* that extend radially outward from the gear plate 32*a* about an outer circumference of the gear plate 32*a* and which are disposed in circumferentially (e.g., angularly) spaced relationship relative to one another to facilitate gripping. The gear plate 32*a* further includes lock bosses 32*c* that depend from a bottom surface of the gear plate 32*a*, and which are disposed at spaced-apart locations relative to one another about an elongated shaft 32*d*. The lock bosses 32*c* are configured to be received within the lock holes 31*c* of the control knob lock assembly 31 to prevent rotation of the control knob 32 relative to the control knob lock assembly 31. The elongated shaft 32*d* has a non-circular shape and includes a number of flat sides 32*e* (e.g., eight sides as shown, although any number of sides may be provided) to facilitate concomitant rotation with the pinion gear assembly 38. The elongated shaft 32*d* further defines a threaded inner surface 32*f* that opens through a distal end of the elongated shaft 32*d* for receipt of a fastener 18*c* of the spring assembly 44 of the control assembly 16. The spring assembly 44 further includes a washer 44*a* and a spring 44*b* that urge the control knob 32 toward a locked position (FIG. 9) when the control knob 32 is lifted to an unlocked position (FIG. 14).

With reference again to FIGS. 3 and 4, the pinion gear assembly 38 includes a tubular shaft 38*a* having an inner surface 38*b* with a number of flat sides 38*c* that correspond with the flat sides 32*e* of the elongated shaft 32*d* of the control knob 32. The tubular shaft 38*a* receives the elongated shaft 32*d* within a lumen 38*d* defined by the inner surface 38*b* of the tubular shaft 38*a* so that the elongated shaft 32*d* of the control knob 32 interlocks with the inner surface 38*b* of the tubular shaft 38*a*. The tubular shaft 38*a* of the pinion gear assembly 38 has an outer surface that supports a pinion gear 38*e* with teeth 38*f* that engage the first curved rack 40 and the second curved rack 42 to cause the first and second curved racks 40 to translate relative to one another in response to rotational movement of the pinion gear assembly 38.

The first curved rack 40 of the control assembly 16 is disposed within the curved heel 24 on a first side of the curved heel 24 between the upper housing portion 18*a* and the lower housing portion 18*b* of the curved heel 24. The first curved rack 40 includes a curved arm 40*a* and a pin mount 40*b* on a first end of the curved arm 40*a*. The first curved arm 40*a* includes teeth 40*c* that are spaced-apart along the curved arm 40*a* for selective engagement with the teeth 38*f* of the pinion gear 38*e* of the pinion gear assembly 38. The teeth 40*c* and the pin mount 40*b* of the first curved arm 40*a* are positioned to face in the distal direction.

The second curved rack 42 of the control assembly 16 is substantially similar to the first curved rack 40 except that the second curved rack 42 is disposed within the curved heel 24 on a second side of the curved heel 24 between the upper housing portion 18*a* and the lower housing portion 18*b* of the curved heel 24, and includes teeth 42*c* on a curved arm 42*a* and a pin mount 42*b* that are positioned to face in the proximal direction. The second side of the curved heel 24 is opposed to the first side of the curved heel 24 with the centerline "CL" of the adjustable spur assembly 10 separating the first and second sides of the curved heel 24.

The first leg assembly 34 of the control assembly 16 includes a leg 34*a* having a pin portion 34*b* on a first end of the first leg assembly 34. The pin portion 34*b* supports a pin 34*c* having an upper segment 34*d* that extends upwardly from an upper surface of the pin portion 34*b* and a lower segment 34*e* that depends from a lower surface of the pin portion 34*b*. The first leg assembly 34 further includes an extension portion 34*f* extending from the leg 34*a* and disposed at an angle relative to the leg 34*a*. The extension portion 34*f* extends from the leg 34*a* to a position lock coupler 34*g* on a second end of the first leg assembly 34.

Figure 7:
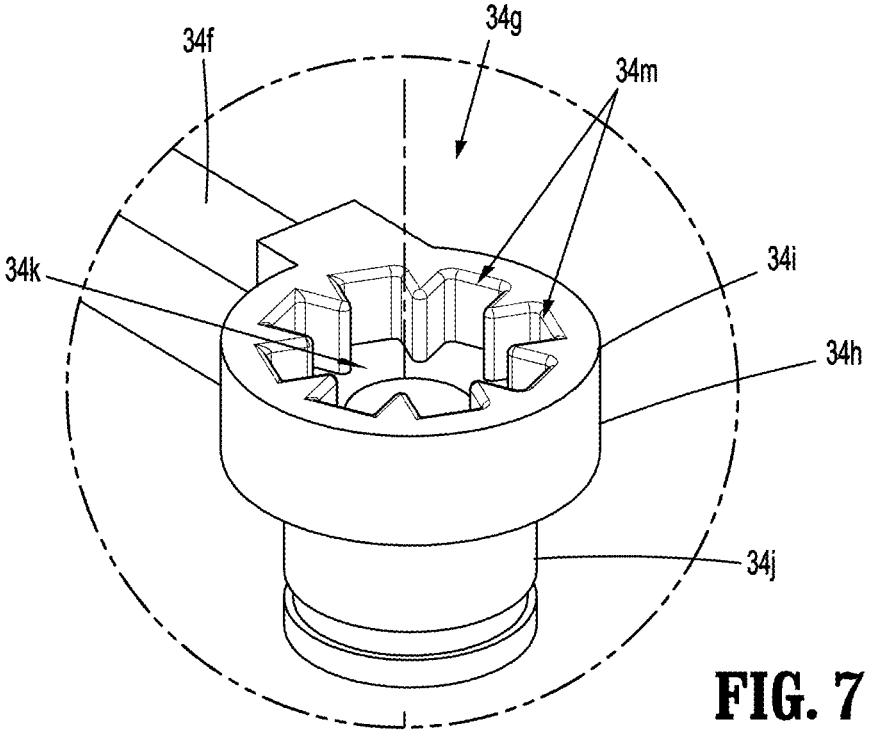
FIG. 7 is an enlarged, perspective view of the indicated area of detail shown in FIG. 4.

As seen in FIG. 7, the position lock coupler 34*g* of the first leg assembly 34 includes a tubular body 34*h* having an upper ring portion 34*i* and a lower shaft portion 34*j*. The tubular body 34*h* has an inner surface that defines a locking lumen 34*k* through the position lock coupler 34*g*. The inner surface of the upper ring portion 34*i* of the position lock coupler 34*g* defines position lock slots 34*m* that extend around the locking lumen 34*k*.

Referring again to FIG. 4, the second leg assembly 36 of the control assembly 16 is similar to the first leg assembly 34, but instead of the position lock coupler 34*g*, the second leg assembly 36 includes a capture ring 36*g* that defines a lumen 36*h* through the capture ring 36*g* for receiving the lower shaft portion 34*j* of the position lock coupler 34*g* of the first leg assembly 34 and for pivotably coupling the first and second leg assemblies 34, 36 together. The pins 34*c* of the first and second leg assemblies 34, 36 are received within the respective first and second cam channels 28*a*, 28*b* of the curved heel 24 of the yoke 12 and are configured to cam along the respective first and second cam channels 28*a*, 28*b* to facilitate relative pivoting movement between the first and second leg assemblies 34, 36 when the control knob 32 rotates to translate the first and second curved racks 40, 42 relative to one another (see FIGS. 13 and 15).

Figure 8:
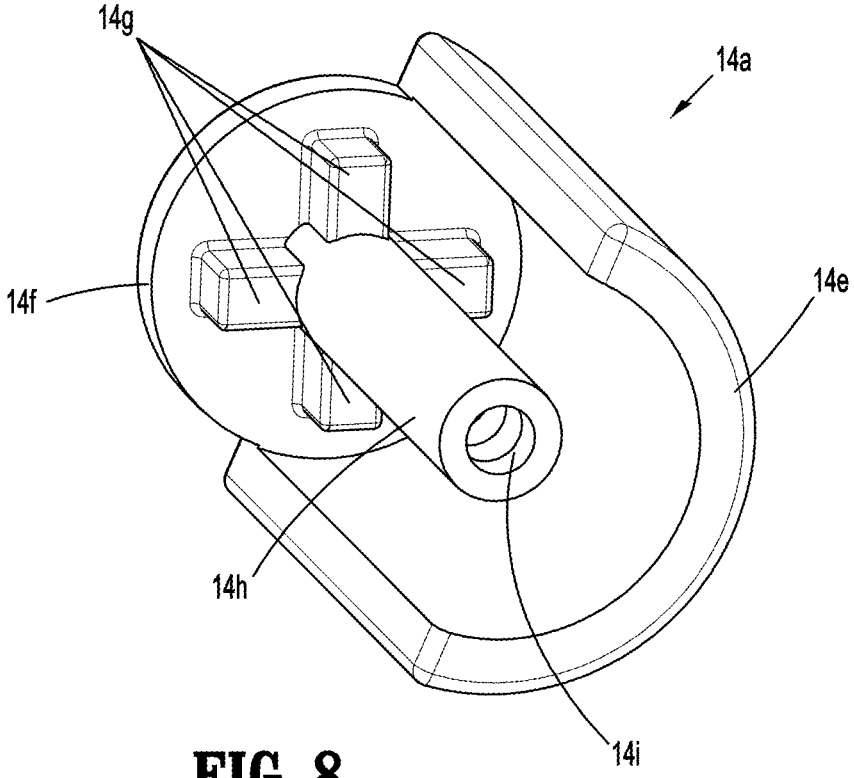
FIG. 8 is an enlarged, perspective view of an active tip of the active end portion of the adjustable spur assembly of FIG. 1.

Turning now to FIGS. 4 and 8, the active tip assembly 14 of the adjustable spur assembly 10 includes an active tip 14*a*, a spring 14*b*, a washer 14*c*, and a fastener 14*d*. The active tip 14*a* includes an engagement wall 14*e*, which is shown with a U-shape configuration although any suitable configuration may be provided, that is configured to contact the horse's side to enable the rider to communicate with the horse. The active tip 14*a* further includes a plate 14*f* having lock bosses 14*g* and an elongated shaft 14*h* descending from a bottom surface of the plate 14*f*. The lock bosses 14*g* are selectively engageable with the position lock slots 34*m* of the position lock coupler 34*g* to maintain the engagement wall 14*e* of the active tip 14*a* in one of a plurality of fixed orientations of the active tip 14*a* relative to the centerline "CL" of the adjustable spur assembly 10. The elongated shaft 14*h* has a threaded inner surface 14*i* that threadedly couples to the fastener 14*d*.

With reference to FIGS. 13-16, to move the active tip 14*a* from a retracted position (FIG. 13) to an extended position (FIG. 15), control knob 32 is moved upward against biasing forces generated by a resulting compression of spring 44*b*, as indicated by arrows "A" in FIG. 14, so that lock bosses 32*c* of the control knob 32 separate from the lock holes 31*c* of the control knob lock assembly 31. With the lock bosses 32*c* separated from the lock holes 31*c*, the control knob 32 can rotate about a rotation axis "R" of the control knob 32 and of the pinion gear assembly 38 (FIG. 14), as indicated by arrow "B" (FIG. 15), so that control knob 32 rotates pinion gear assembly 38 causing pinion gear assembly 38 to translate the first and second curved racks 40, 42 relative to another, as indicated by arrows "C" (FIG. 15). As the first and second curved racks 40, 42 translate relative to another, pins 34*c* of the first and second curved racks 40, 42 cam along respective first and second cam channels 28*a*, 28*b* toward (or away from) one another, depending on a direction of rotation of the control knob 32 (e.g., clockwise and/or counterclockwise). When pins 34*c* of the first and second curved racks 40, 42 cam along respective first and second cam channels 28*a*, 28*b* and curve toward (or away from) one another, the first and second leg assemblies 34 and 36 pivot about a pivot axis "P" defined by the elongated shaft 14*h* of the active tip 14*a* (FIG. 11) so that the legs 34*a*, 36*a* of the respective first and second leg assemblies 34, 36 pivot toward (or away from) one another and cause the active tip assembly 14 to translate distally away from (or proximally toward) the curved heel 24 of the yoke 12 to any number of extended (or retracted) positions, as indicated by arrows "D" (FIG. 15).

Figure 9:
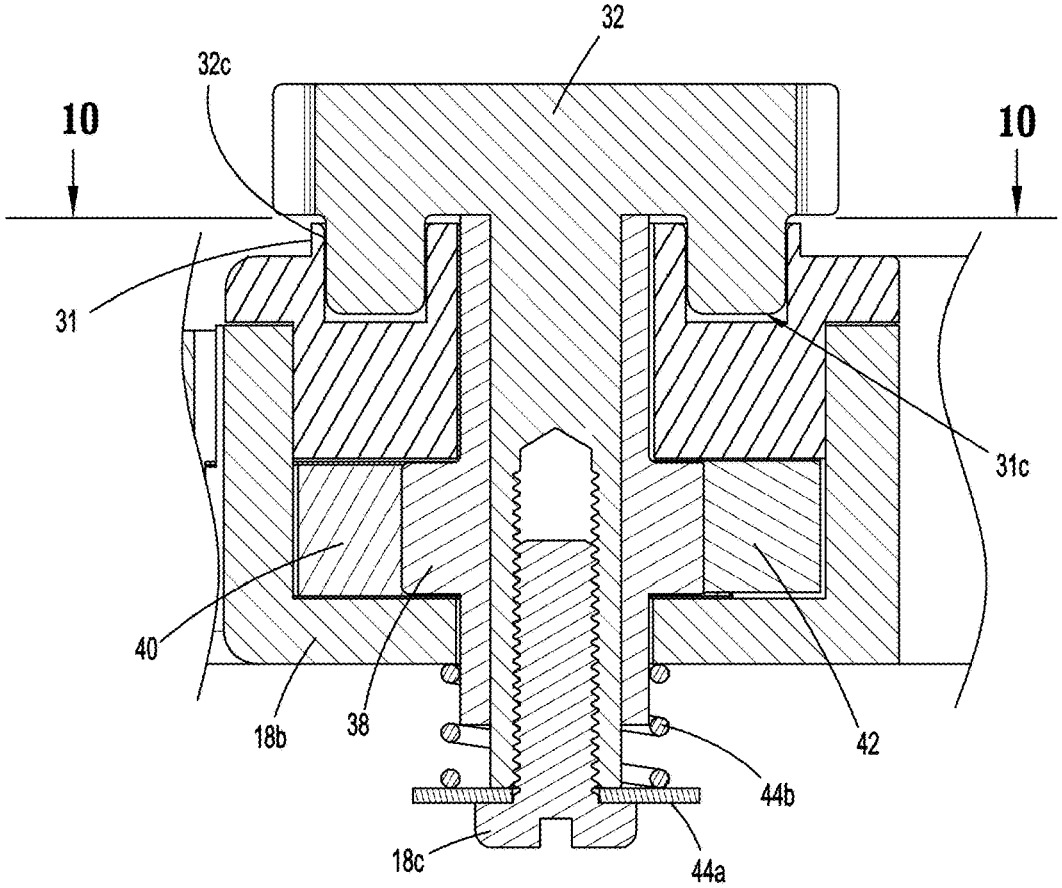
FIG. 9 is an enlarged, cross-sectional view of a portion of the adjustable spur assembly of FIG. 1 as taken along section line 9-9 of FIG. 1.
Figure 10:
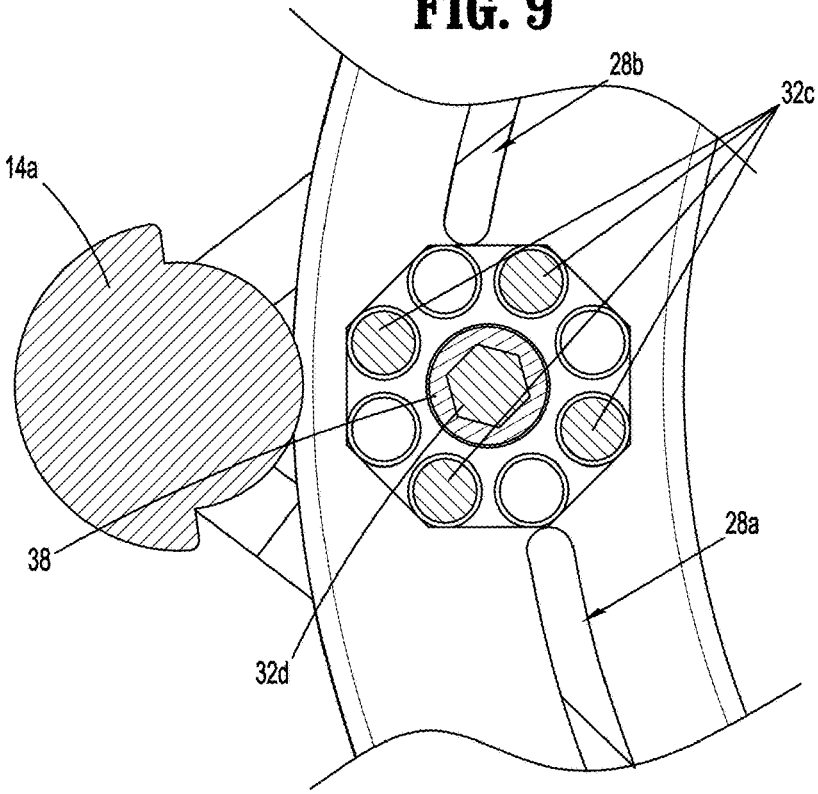
FIG. 10 is a cross-sectional view of a portion of the adjustable spur assembly of FIG. 1 as taken along section line 10-10 of FIG. 9.
Figure 11:
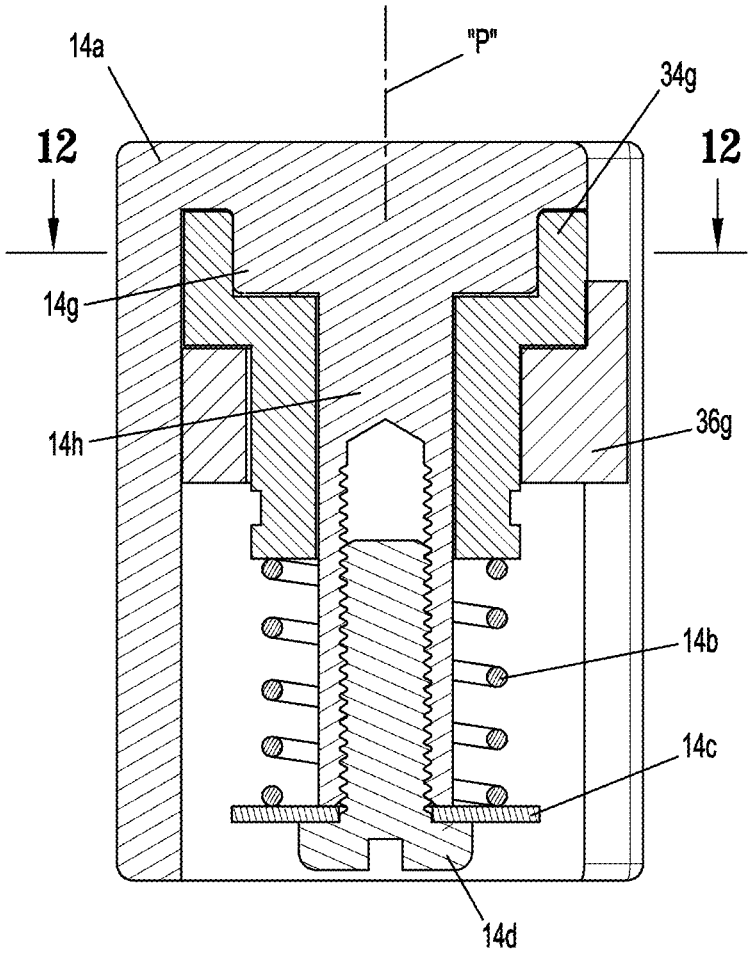
FIG. 11 is an enlarged, cross-sectional view of a portion of the adjustable spur assembly of FIG. 1 as taken along section line 11-11 of FIG. 1 and illustrating the active tip locked in a first rotational position.
Figure 12:
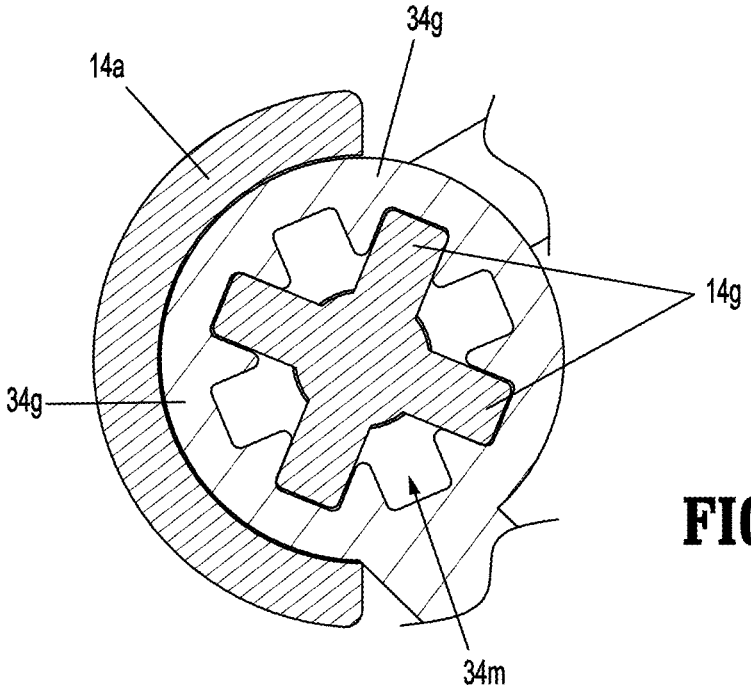
FIG. 12 is a cross-sectional view of a portion of the adjustable spur assembly of FIG. 1 as taken along section line 12-12 of FIG. 11.

When active tip assembly 14 is disposed at a desired distance from the curved heel 24, the spring forces of spring 44*b* are configured to urge control knob 32 downward (e.g., opposite to the direction of arrows "A") so that lock bosses 32*c* of the control knob 32 engage the lock holes 31*c* of the control knob lock assembly 31 and prevent the control knob 32 from rotating, fixing the active tip assembly 14 at the desired distance from the curved heel 24 (see FIGS. 9 and 10).

Turning now to FIGS. 11, 12, 17 and 18, to rotate the active tip 14*a* about the position lock coupler 34*g* of the control assembly 16 from a locked position (FIGS. 11 and 12) to an unlocked position (FIG. 17), the active tip 14*a* is moved upward against the biasing forces of spring 14*b* relative to the position lock coupler 34*g*, as indicated by arrows "E." This upward movement of the active tip 14*a* relative to the position lock coupler 34*g* causes lock bosses 14*g* of the active tip 14*a* to separate from the lock slots 34*m* of the position lock coupler 34*g*. With the lock bosses 14*g* separated from the lock slots 34*m* of the position lock coupler 34*g*, the active tip 14*a* can be rotated relative to the position lock coupler 34*g*, as indicated by arrow "F", to rotationally reorient the active tip 14*a* relative to the position lock coupler 34*g*. Once the desired rotational orientation of the active tip 14*a* is achieved, the biasing forces of the spring 14*b* are configured to urge the active tip 14*a* downwardly toward the position lock coupler 34*g* so that the lock bosses 14*g* engage the lock slots 34*m* and prevent the active tip 14*a* from rotating relative to the position lock coupler 34*g*.

These axial and/or rotational movements of the active tip 14*a* provided by the disclosed adjustable spur assembly 10 enable the rider to communicate differently with the horse, for instance, if the rider needs more and/or less responsiveness from the horse, depending on the horse and/or event.

In aspects, any of the disclosed active tips may be uniformly shaped (e.g., a ball) and may not need to be repositioned such as some of disclosed active tips that have a biased directional shape (e.g., a rowel tip).

Figure 28:
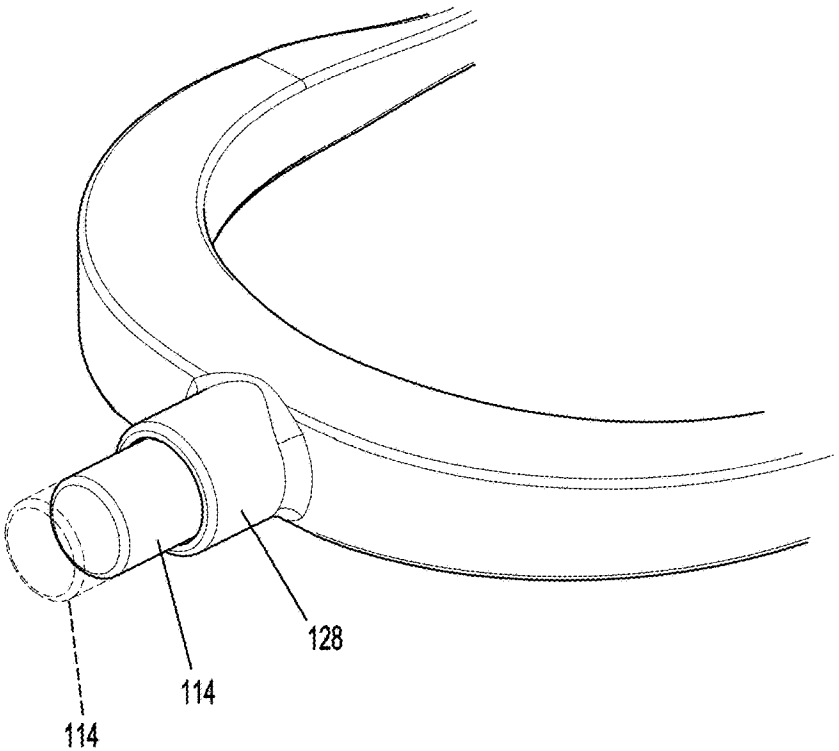
Figure 27:
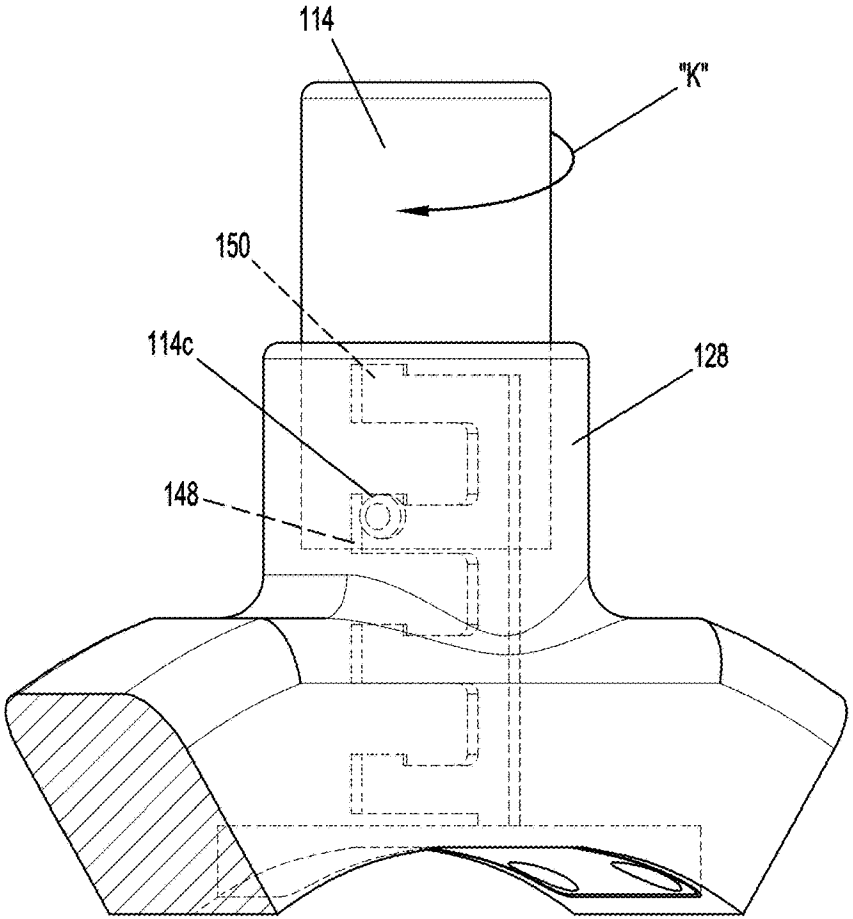
Figure 30:
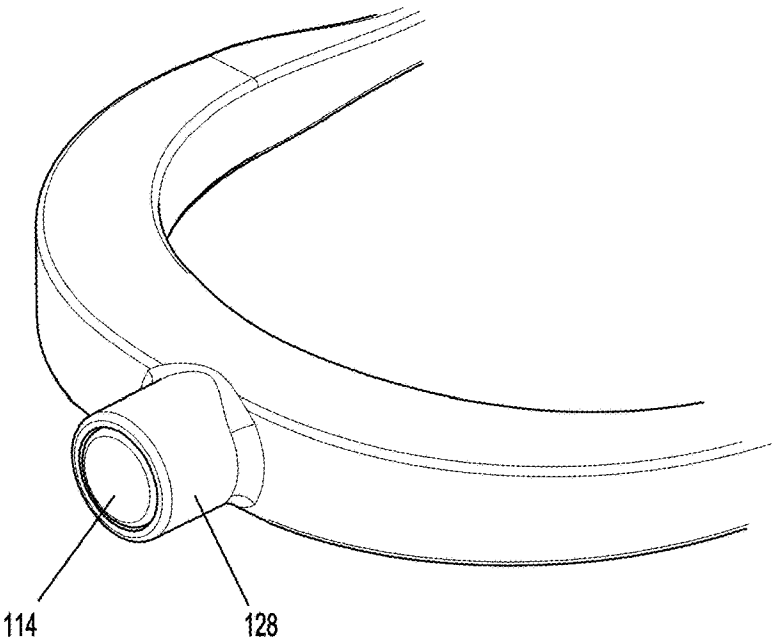

Turning now to FIGS. 19-30, another adjustable spur assembly, in accordance with the present disclosure, is generally referred to as 100. The adjustable spur assembly 100 has a proximal or base end portion 100*a* and a distal or active end portion 100*b* that extends distally from the base end portion 100*a*. The adjustable spur assembly 100 includes a yoke 112, an active tip assembly 114, a spring 115, and a control assembly 116 that couples the yoke 112 and the active tip assembly 114 together and facilitates movement of the active tip assembly 114 relative to the yoke 112 between one or more extended (FIG. 19) and/or retracted positions (FIGS. 28 and 30).

The yoke 112 of the adjustable spur assembly 100 has a U-shaped body 118 with a curved heel 124 similar to the curved heel 24 of the yoke 12 of the adjustable spur assembly 10. Curved heel 124 includes an apex portion 126. The apex portion 126 further includes a distal portion 126*a* and a proximal portion 126*b* defining a plate recess 130 configured to receive a support plate 132. The apex portion 126 further defines insert bores 134 configured to receive a distal portion of threaded inserts 135 therein. The support plate 132 defines fastener openings 132*a* therethrough for receiving fasteners 136 therethrough and for receiving a proximal portion of threaded inserts 135 therein to enable fasteners 136 to threadedly couple to threaded inserts 135 for securing support plate 132 within plate recess 130 of the apex portion 126.

The active tip assembly 114 of the adjustable spur assembly 100 includes a tubular body 114*a* defining a central bore 114*b* that opens through a proximal end portion of the tubular body 114*a* for receiving the spring 115. The active tip assembly 114 further includes bosses 114*c* (e.g., four) at spaced apart locations about the outer surface of tubular body 114*a*. The bosses 114*c* are disposed on the proximal end portion the tubular body 114*a*.

The control assembly 116 includes a tubular shaft 128 that extends distally from a distal portion 126*a* of the apex portion 126. The tubular shaft 128 defines a central passage 138 which opens at the distal end of the tubular shaft 128 and extends through the apex portion 126 and opens into the plate recess 130. The tubular shaft 128 includes an inner surface 140 having a number of boss channels 142 (e.g., four) recessed into the inner surface 140, disposed about the central passage 138, and spaced apart from one another. Each boss channel 142 has a proximal opening 144 at a proximal end portion of the apex portion 126 for receiving one of the respective bosses 114*c* of the active tip assembly 114. Each boss channel 142 includes an elongated spine 146 and a number of legs 148 that are longitudinal spaced apart from one another along a centerline "CL2" of the adjustable spur assembly 100. Each leg 148 extends to a toe 150 that extends distally from the respective leg 148 on a free end of the leg 148. As can be appreciated, although the boss channels 142 are shown perpendicular to the elongated spine 146, one or more of the boss channels 142 (or portions thereof—e.g., legs 148, and/or toes 150) can be disposed at any suitable angle relative to elongated spine 146 (e.g., acute, obtuse, etc.). Similarly, although legs 148 and toes 150 are shown perpendicular to one another, legs 148 and/or toes 150 of one or more of the boss channels 142 may likewise be disposed at any suitable angle relative to one another (e.g., acute, obtuse, etc.). Indeed, the elongated spine 146, one or more of the boss channels 142 (or portions thereof), bosses 114*c* of active tip assembly, and/or any other component of the disclosed adjustable spur assemblies may have any suitable shape and/or configuration (e.g., spiral, curved, rounded, flat, etc.).

Figure 29:
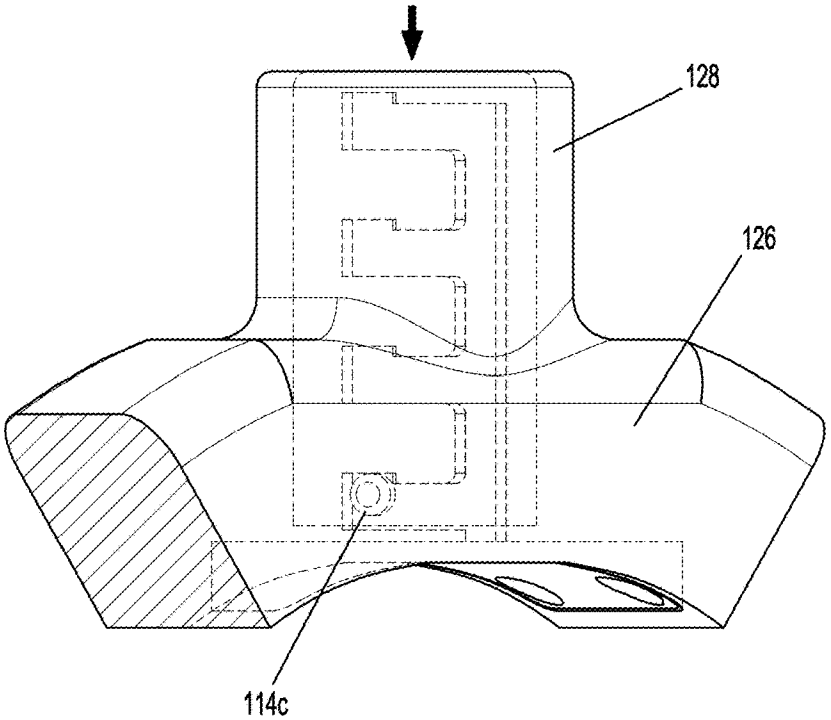
Figure 31:
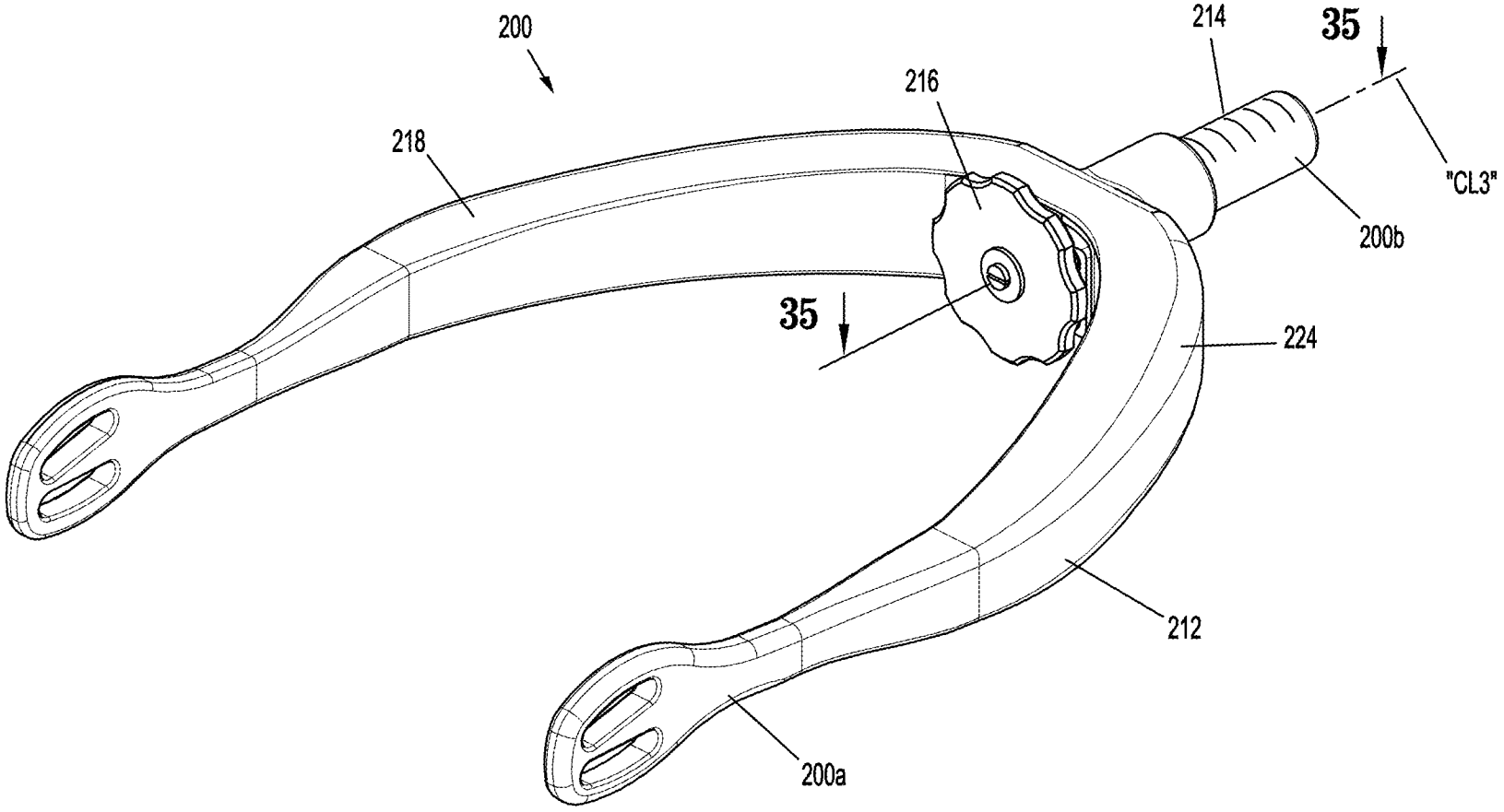
FIG. 31 is a perspective view of still another adjustable spur assembly shown with an active end portion thereof in an extended position in accordance with aspects of this disclosure.
Figure 32:
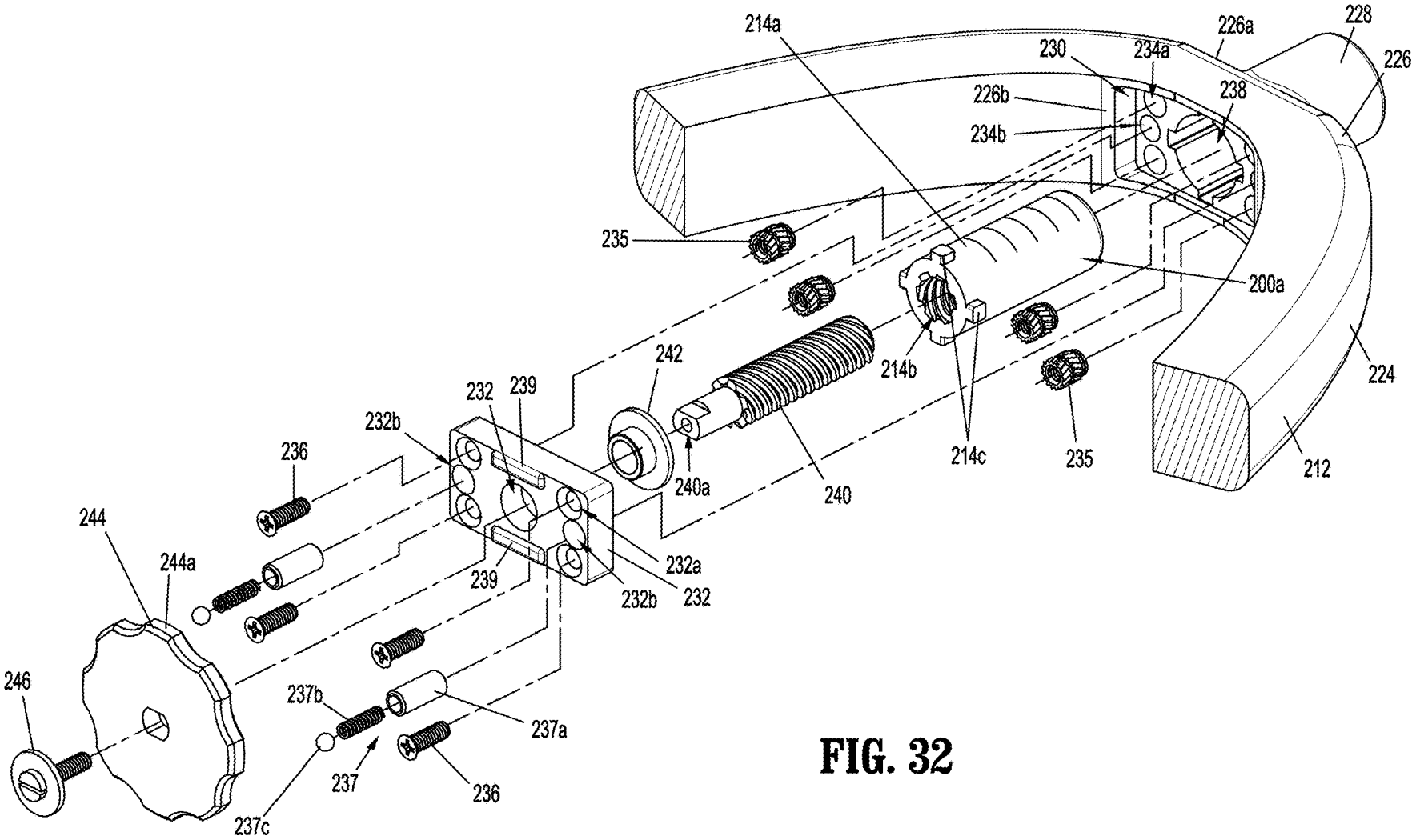
FIG. 32 is a perspective view, with parts separated, of the adjustable spur assembly of FIG. 31.
Figure 33:
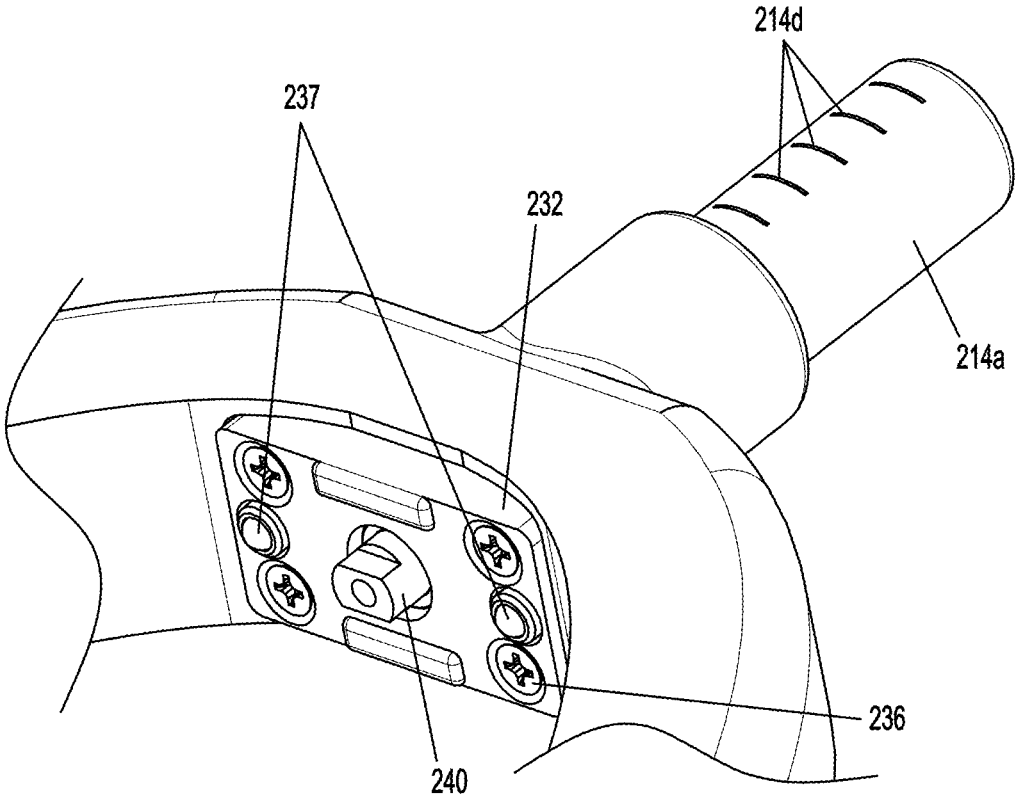
FIG. 33 is an enlarged, perspective view of a portion of the adjustable spur assembly of FIG. 31.
Figure 34:
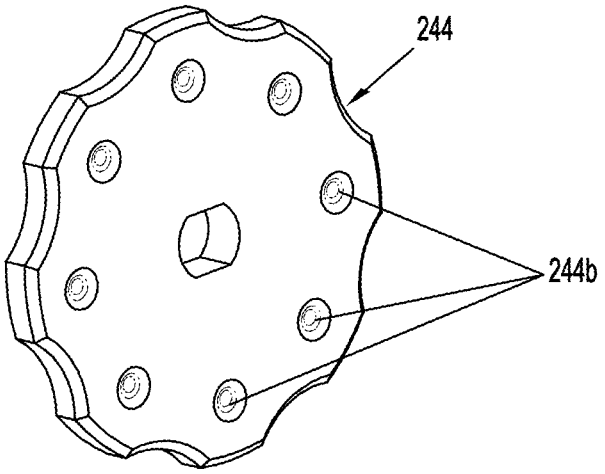
FIG. 34 is an enlarged, perspective view of a control knob of the adjustable spur assembly of FIG. 31.
Figure 36:
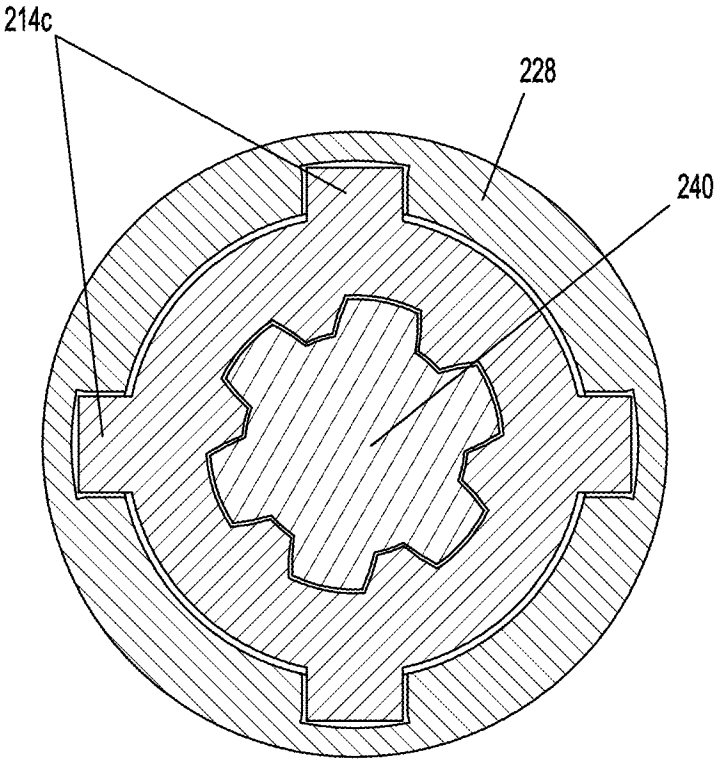
FIG. 36 is an enlarged, cross-sectional view of FIG. 35 as taken along section line 36-36 shown in FIG. 35.
Figure 35:
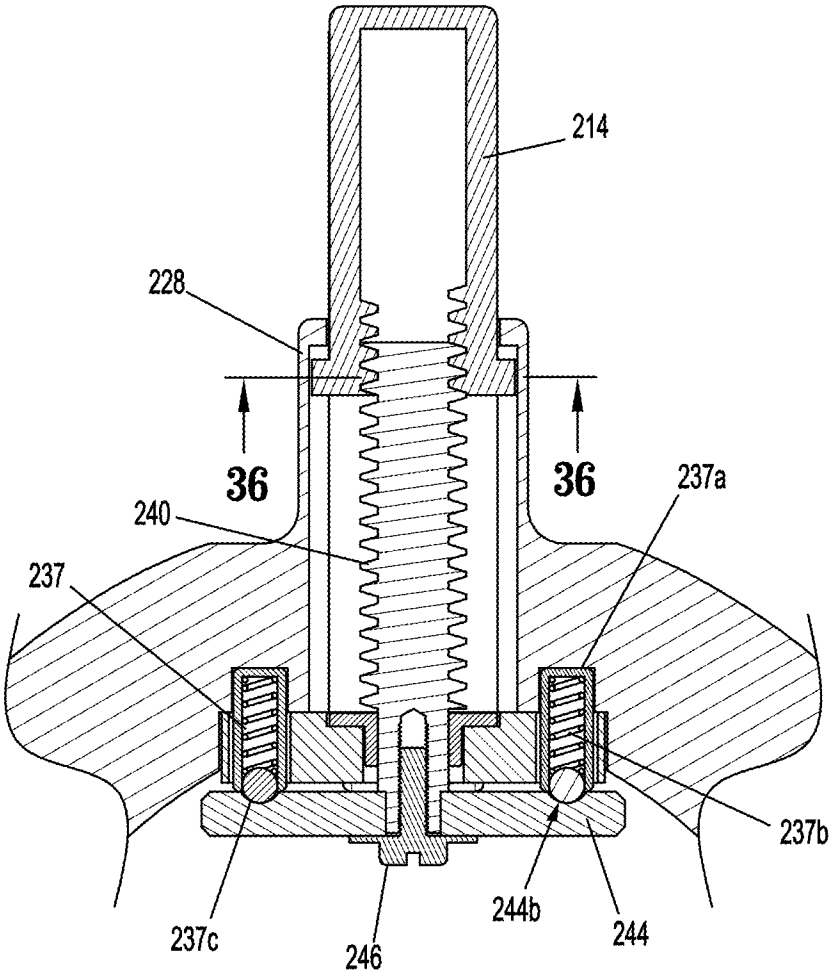
FIG. 35 is an enlarged, cross-sectional view of a portion of the adjustable spur assembly of FIG. 31 as taken along section line 35-35 shown in FIG. 31.

With reference to FIGS. 23-28, the spring 115 of the adjustable spur assembly 100 urges active tip assembly 114 of the adjustable spur assembly 100 in a distal direction, as indicated by arrow "G" (FIG. 24) to maintain the bosses 114*c* of the active tip assembly 114 in the toes 150 of the boss channels 142 of the tubular shaft 128 to prevent the active tip assembly 114 from rotating relative to the tubular shaft 128, and for maintaining the active tip assembly 114 in an axially or longitudinally fixed position relative to the tubular shaft 128. To move the active tip assembly 114 relative to the tubular shaft 128 from a first longitudinal position to a second longitudinal position, the active tip assembly 114 is pushed in a proximal direction, against the bias of the spring 115, toward the tubular shaft 128 and yoke 112, as indicated by arrow "H" (FIG. 25), to move the bosses 114*c* of the active tip assembly 114 out of the respective toes 150 and into the respective legs 148 of the boss channels 142 of the tubular shaft 128. While maintaining the active tip assembly 114 depressed sufficiently to maintain the bosses 114*c* of the active tip assembly 114 aligned with the respective legs 148 of the boss channels 142 of the tubular shaft 128, the active tip assembly 114 is rotated, as indicated by arrow "I", about a rotation axis "RA" of the active tip assembly 114, so that the bosses 114*c* of the active tip assembly 114 cam through the respective legs 148 towards the respective spines 146 of the respective boss channels 142 of the tubular shaft 128. Once the bosses 114*c* are aligned with the respective spines 146, the active tip assembly 114 can be moved farther in the proximal direction toward (or distal direction away from, depending on which legs 148 the bosses 114*c* were disposed in) the tubular shaft 128, as indicated by arrow "J" until the bosses 114*c* align with another one of the respective legs 148, which is longitudinally offset from the prior legs 148 within which the bosses 114*c* were disposed. The active tip assembly 114 can then be rotated in a direction opposite to the direction of arrow "I", as indicated by arrow "K", until aligned with the respective toes 150 of the respective legs 148 of the respective boss channels 142, where the spring 115 urges the bosses 114*c* distally into the respective toes 150 to longitudinally and rotationally lock the position of the active tip assembly 114 relative to the tubular shaft 128. FIGS. 29 and 30 illustrate the active tip assembly 114 full depressed into the tubular shaft 128. As can be appreciated, the longitudinal position of the active tip assembly 114 relative to the tubular shaft 128 can be changed as desired.

Figure 39:
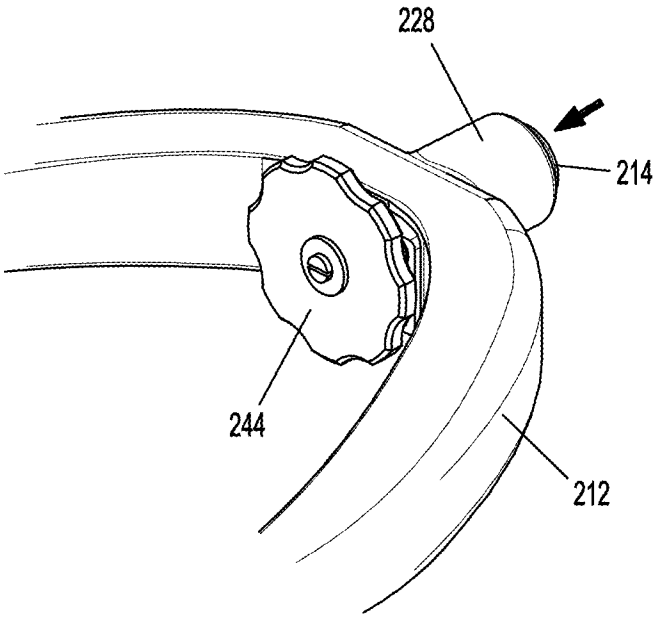

Turning now to FIGS. 31-39, yet another adjustable spur assembly, in accordance with the present disclosure, is generally referred to as 200 and is similar to adjustable spur assembly 100. The adjustable spur assembly 200 has a proximal or base end portion 200*a* and a distal or active end portion 200*b* that extends distally from the base end portion 200*a*. The adjustable spur assembly 200 includes a yoke 212, an active tip assembly 214, and a control assembly 216 that facilitates movement of the active tip assembly 214 relative to the yoke 212 between one or more extended (FIG. 31) and/or retracted positions (FIG. 39).

The yoke 212 of the adjustable spur assembly 100 has a U-shaped body 218 with a curved heel 224 similar to the curved heel 124 of the yoke 112 of the adjustable spur assembly 100. Curved heel 224 includes an apex portion 226. The apex portion 226 further includes a distal portion 226*a* and a proximal portion 226*b* defining a plate recess 230 configured to receive a support plate 232. The apex portion 226 further defines insert bores 234*a* configured to receive a distal portion of threaded inserts 235 therein and spring plunger bores 234*b* for receiving spring plunger assemblies 237 therein. The support plate 232 defines fastener openings 232*a* therethrough for receiving fasteners 236 therethrough and for receiving a proximal portion of threaded inserts 235 therein to enable fasteners 236 to threadedly couple to threaded inserts 235 for securing the support plate 232 within the plate recess 230 of the apex portion 226. The support plate 232 further defines spring plunger holes 232*b* for receiving the spring plunger assemblies 237 therein. The spring plunger assemblies 237 include a tube 237*a*, a spring 237*b* supported in the tube 237*a*, and a ball 237*c* coupled to the tube 237*a* and engaged with the spring 237*b*. The support plate 232 further defines a central opening 233 therethrough and elongated ribs 239 that extend on opposite sides of the central opening 233 on a proximal end surface of the support plate 232.

The active tip assembly 214 of the adjustable spur assembly 200 includes a tubular body 214*a* defining a threaded central bore 214*b* that opens through a proximal end portion of the tubular body 214*a* and including longitudinally spaced apart graduations 214*d* for indicating different positions of the active tip assembly 214 relative to the yoke 212. The active tip assembly 214 further includes bosses 214*c* (e.g., four) at spaced apart locations about the outer surface of tubular body 214*a*. The bosses 214*c* are disposed on the proximal end portion the tubular body 214*a*.

The control assembly 216 of the adjustable spur assembly 200 includes a tubular shaft 228 that extends distally from the distal portion 226*a* of the apex portion 226. The tubular shaft 228 defines a central passage 238 which opens at the distal end of the tubular shaft 228 and extends through the apex portion 226 and opens into the plate recess 230. The central passage 238 includes a boss channels 238*a* that extend distally along the tubular shaft 228 for slidably receiving the bosses 214*c* of the active tip assembly 214. In aspects, the tubular shaft 228 can include the bosses 214*c* and the active tip assembly 214 can define the boss channels 238*a* and/or each of the active tip assembly 214 and the tubular shaft 228 can include one or more bosses 214*c* and define one or more boss channels 238*a*. The control assembly 216 further includes a lead screw 240 that threadedly couples to the threaded central bore 214*b* of the active tip assembly 214, a support cap 242 that couples to the central opening 233 of the support plate 232 for supporting a proximal end portion of the lead screw 240, a control knob or rotatable wheel 244 with ridges 244*a* to facilitate gripping, and a fastener 246 for coupling the rotatable wheel 244 to a threaded opening 240*a* defined in the proximal end portion of the lead screw 240. The rotatable wheel 244 further includes detents 244*b* at angularly spaced positions about an outer periphery of the rotatable wheel 244 on a distal end surface of the rotatable wheel 244.

Figure 37:
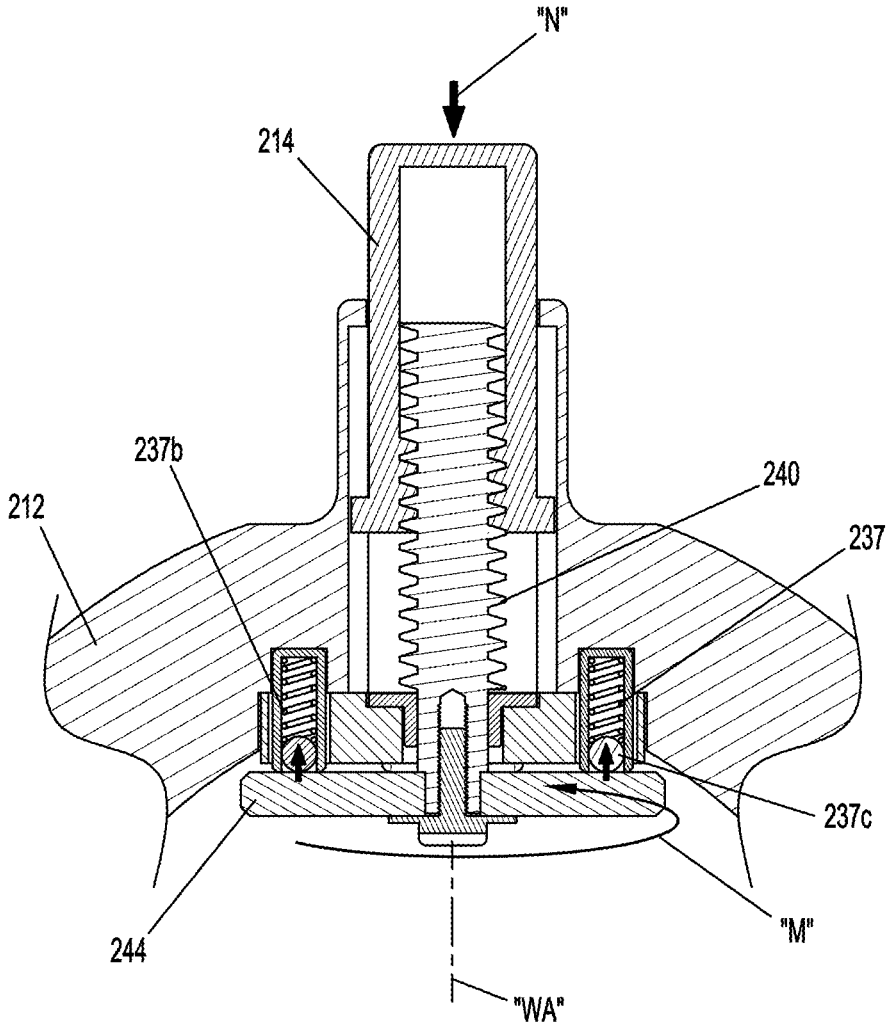
FIGS. 37-39 are progressive views illustrating the active end portion moving from the extended position to a retracted position.
Figure 38:
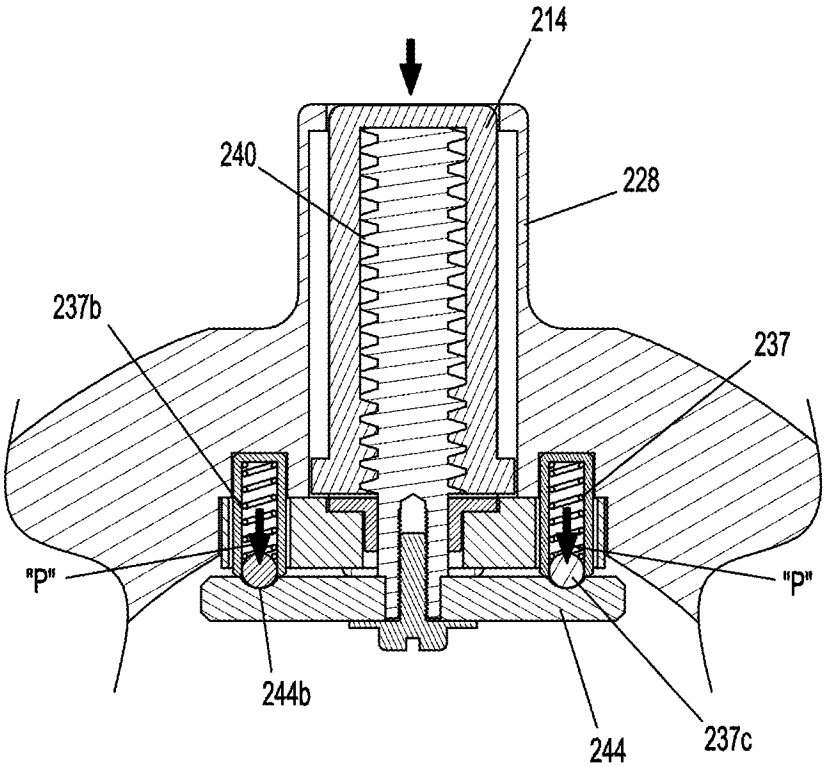

With reference to FIGS. 37-39, to move the active tip assembly 214 relative to the yoke 212, the rotatable wheel 244 is rotated about a wheel axis "WA" that this colinear with a centerline "CL3" of the adjustable spur assembly 200, as indicated by arrow "M" (FIG. 37). Rotation of the rotatable wheel 244 rotates the lead screw 240 which causes the active tip assembly 214 to longitudinally translate between extended and/or retracted positions, as indicated by arrow "N." Rotation of the rotatable wheel 244 with sufficient force to overcome the spring force onto the balls 237*c* from the springs 237*b*, causes the balls 237*c* to cam out of the detents 244*b* and compress the springs 237*b* until the rotatable wheel 244 is rotated to the same or different detents 244*b*, where the springs 237*b* urge the balls 237*c* back into the same or different detents 244*b*, as indicated by arrows "P" and locks the longitudinal position of the active tip assembly 214. This process can be repeated as desired to achieve a desired longitudinal position of the active tip assembly 214 relative to the yoke 212.

In aspects, any component or portions thereof (e.g., elongated spine 146, boss channels 142, bosses 114*c*, etc.) of any of the disclosed adjustable spur assemblies 10, 100, 200 may have interruptions, surface texture, coatings, etc. to facilitate operability of the disclosed adjustable spur assemblies 10, 100, 200.

Further aspects of the present disclosure are provided by the subject matter of the following clauses.

1. An adjustable spur assembly, comprising a yoke configured to mount to a rider's footwear, an active tip assembly; and a control assembly operably coupled to the active tip assembly and configured to enable the active tip assembly to move relative to the yoke between extended and retracted positions.
2. The adjustable spur assembly of clause 1, wherein the active tip assembly is configured to rotate from a first position to a second position when in one of the extended or retracted positions.
3. The adjustable spur assembly of any of the preceding clauses, wherein the control assembly includes a control knob, and wherein the active tip assembly axially translates relative to the yoke in response to a rotation of the control knob.
4. The adjustable spur assembly of any of the preceding clauses, wherein the control knob is configured to move between a rotationally locked position and a rotatable position.
5. The adjustable spur assembly of any of the preceding clauses, wherein the control knob is operably coupled to at least one rack by a pinion gear assembly, and wherein a rotation of the control knob rotates the pinion gear assembly to translate the at least one rack.
6. The adjustable spur assembly of any of the preceding clauses, wherein at least one leg assembly is pivotably coupled to the at least one rack, and wherein the active tip assembly is connected to the at least one leg assembly such that translation of the at least one rack pivots the at least one leg assembly and translates the active tip assembly relative to the yoke.
7. The adjustable spur assembly of any of the preceding clauses, wherein the control assembly includes a tubular shaft coupled to the yoke, and wherein the active tip assembly is positioned to translate through the tubular shaft as the active tip assembly moves between the extended and retracted positions.
8. The adjustable spur assembly of any of the preceding clauses, wherein at least one of the active tip assembly or the tubular shaft includes at least one boss, wherein at least one of the active tip assembly or the tubular shaft defines at least one channel, and wherein the at least one boss is configured to translate through the at least one channel.
9. The adjustable spur assembly of any of the preceding clauses, wherein the at least one boss is configured to rotate and translate through the at least one channel.
10. The adjustable spur assembly of any of the preceding clauses, further comprising a lead screw or a spring that cooperates with the active tip assembly for disposing the active tip assembly in the extended and retracted positions.

11. An adjustable spur assembly, comprising a yoke including a curved heel, a first arm extending from a first side of the curved heel and a second arm extending from the second side of the curved heel, the first and second arms configured to couple to a strap to enable the yoke to be secured to a rider's footwear; an active tip assembly for communicating with a horse; and a control assembly operably coupled to the active tip assembly and configured to move the active tip assembly between extended and retracted positions relative to the yoke.

12. The adjustable spur assembly of any of the preceding clauses, wherein the active tip assembly is configured to rotate from a first position to a second position when in one of the extended or retracted positions.

13. The adjustable spur assembly of any of the preceding clauses, wherein the control assembly includes a control knob, and wherein the active tip assembly axially translates relative to the yoke in response to a rotation of the control knob.

14. The adjustable spur assembly of any of the preceding clauses, wherein the control knob is configured to move between a rotationally locked position and a rotatable position.

15. The adjustable spur assembly of any of the preceding clauses, wherein the control knob is operably coupled to at least one rack by a pinion gear assembly, and wherein a rotation of the control knob rotates the pinion gear assembly to translate the at least one rack.

16. The adjustable spur assembly of any of the preceding clauses, wherein at least one leg assembly is pivotably coupled to the at least one rack, and wherein the active tip assembly is connected to the at least one leg assembly such that translation of the at least one rack pivots the at least one leg assembly and translates the active tip assembly relative to the yoke.

17. The adjustable spur assembly of any of the preceding clauses, wherein the control assembly includes a tubular shaft coupled to the yoke, and wherein the active tip assembly is positioned to translate through the tubular shaft as the active tip assembly moves between the extended and retracted positions.

18. The adjustable spur assembly of any of the preceding clauses, wherein at least one of the active tip assembly or the tubular shaft includes at least one boss, wherein at least one of the active tip assembly or the tubular shaft defines at least one channel, and wherein the at least one boss is configured to translate through the at least one channel.

19. The adjustable spur assembly of any of the preceding clauses, wherein the at least one boss is configured to rotate and translate through the at least one channel.

20. The adjustable spur assembly of any of the preceding clauses, further comprising a lead screw or a spring that cooperates with the active tip assembly for disposing the active tip assembly in the extended and retracted positions.

Persons skilled in the art will understand that the structures and methods specifically described herein and shown in the accompanying figures are non-limiting exemplary embodiments, and that the description, disclosure, and figures should be construed merely as exemplary of particular embodiments. It is to be understood, therefore, that the present disclosure is not limited to the precise embodiments described, and that various other changes and modifications may be effected by one skilled in the art without departing from the scope or spirit of the disclosure. Additionally, the elements and features shown or described in connection with certain embodiments may be combined with the elements and features of certain other embodiments without departing from the scope of the present disclosure, and that such modifications and variations are also included within the scope of the present disclosure. Accordingly, the subject matter of the present disclosure is not limited by what has been particularly shown and described.

What is claimed is:

1. An adjustable spur assembly, comprising:

a yoke configured to mount to a rider's footwear;

an active tip assembly; and a control assembly operably coupled to the active tip assembly and configured to enable the active tip assembly to move relative to the yoke between extended and retracted positions, and wherein the active tip assembly is selectively securable in at least one discrete position between the extended and retracted positions, wherein the control assembly includes a tubular shaft coupled to the yoke, and wherein the active tip assembly is positioned to translate through the tubular shaft as the active tip assembly moves between the extended and retracted positions.

2. The adjustable spur assembly of claim 1, wherein at least one of the active tip assembly or the tubular shaft includes at least one boss, wherein at least one of the active tip assembly or the tubular shaft defines at least one channel, and wherein the at least one boss is configured to translate through the at least one channel.

3. The adjustable spur assembly of claim 2, wherein the at least one boss is configured to rotate and translate through the at least one channel.

4. The adjustable spur assembly of claim 2, further comprising a lead screw that cooperates with the active tip assembly for moving the active tip assembly relative to the yoke in response to rotation of the lead screw, the lead screw further configured to selectively secure the active tip assembly in the extended position, the retracted position, or the at least one discrete position when stationary.

5. The adjustable spur assembly according to claim 1, wherein the control assembly includes a spring plunger assembly and a wheel, the wheel being rotatable relative to the yoke.

6. The adjustable spur assembly according to claim 5, wherein the wheel includes a plurality of detents.

7. The adjustable spur assembly according to claim 6, wherein a first rotation of the wheel relative to the yoke causes a ball from the spring plunger assembly to move into engagement with a first detent of the plurality of detents of the wheel to secure the active tip assembly in the extended position.

8. The adjustable spur assembly according to claim 7, wherein a second rotation of the wheel relative to the yoke causes the ball from the spring plunger assembly to move from engagement with the first detent into engagement with a second detent of the plurality of detents of the wheel to secure the active tip assembly in the at least one discrete position.

9. The adjustable spur assembly according to claim 7, wherein the spring plunger assembly includes a spring that urges the ball towards the wheel.

10. An adjustable spur assembly, comprising:

a yoke including a curved heel, a first arm extending from a first side of the curved heel and a second arm extending from the second side of the curved heel, the first and second arms configured to couple to a strap to enable the yoke to be secured to a rider's footwear;

an active tip assembly for communicating with a horse; and a control assembly operably coupled to the active tip assembly and configured to move the active tip assembly between extended and retracted positions relative to the yoke, wherein the active tip assembly is selectively securable in at least one discrete position between the extended and retracted positions, and wherein in the at least one discrete position, the active tip assembly is axially fixed relative to the yoke, wherein the control assembly includes a tubular shaft coupled to the yoke, and wherein the active tip assembly is positioned to translate through the tubular shaft as the active tip assembly moves between the extended and retracted positions.

11. The adjustable spur assembly of claim 10, wherein at least one of the active tip assembly or the tubular shaft includes at least one boss, wherein at least one of the active tip assembly or the tubular shaft defines at least one channel, and wherein the at least one boss is configured to translate through the at least one channel.

12. The adjustable spur assembly of claim 11, wherein the at least one boss is configured to rotate and translate through the at least one channel.

13. The adjustable spur assembly of claim 11, further comprising a lead screw that cooperates with the active tip assembly for moving the active tip assembly relative to the yoke in response to rotation of the lead screw, the lead screw configured to selectively secure the active tip assembly in the extended position, the retracted position, or the at least one discrete position when stationary.

14. The adjustable spur assembly according to claim 10, wherein the control assembly includes a spring plunger assembly and a wheel, the wheel being rotatable relative to the yoke.

15. The adjustable spur assembly according to claim 14, wherein the wheel includes a plurality of detents.

16. The adjustable spur assembly according to claim 15, wherein a first rotation of the wheel in a first direction relative to the yoke causes a ball from the spring plunger assembly to move into engagement with a first detent of the plurality of detents of the wheel to secure the active tip assembly in the extended position.

17. The adjustable spur assembly according to claim 16, wherein a second rotation of the wheel in the first direction relative to the yoke causes the ball from the spring plunger assembly to move from engagement with the first detent into engagement with a second detent of the plurality of detents of the wheel to secure the active tip assembly in the at least one discrete position.

18. The adjustable spur assembly according to claim 17, wherein the wheel is rotatable in the first direction or a second direction opposite to the first direction so that the ball can move from engagement with the second detent into engagement with the first detent when the wheel is rotated in the second direction.

* * * * *